US007905491B2

(12) United States Patent
Gray

(10) Patent No.: US 7,905,491 B2
(45) Date of Patent: Mar. 15, 2011

(54) WOBBLING GAME SYSTEM

(76) Inventor: David L. Gray, Midland, TX (US)

( * ) Notice: Subject to any disclaimer, the term of this patent is extended or adjusted under 35 U.S.C. 154(b) by 71 days.

(21) Appl. No.: 12/388,284

(22) Filed: Feb. 18, 2009

(65) Prior Publication Data

US 2009/0200743 A1 Aug. 13, 2009

Related U.S. Application Data

(63) Continuation-in-part of application No. 12/203,516, filed on Sep. 3, 2008.

(60) Provisional application No. 61/028,509, filed on Feb. 13, 2008.

(51) Int. Cl.
*A63F 9/26* (2006.01)

(52) U.S. Cl. ..... 273/450; 273/449

(58) Field of Classification Search ..... 273/440, 273/449, 450, 138.2; 473/118; 220/603; 446/396

See application file for complete search history.

(56) References Cited

U.S. PATENT DOCUMENTS

| | | | | | |
|---|---|---|---|---|---|
| 295,429 | A * | 3/1884 | Reach | 482/109 |
| 1,228,615 | A * | 6/1917 | Stafford | 40/608 |
| 1,425,945 | A * | 8/1922 | Congdon, Jr. | 40/608 |
| 1,452,396 | A * | 4/1923 | Sterner et al. | 40/607.1 |
| 1,465,642 | A * | 8/1923 | Keene | 248/111 |
| 2,458,306 | A | 1/1949 | Schneider | |
| 2,551,668 | A | 5/1951 | Goosmann | |
| 3,092,384 | A * | 6/1963 | Herne | 273/459 |
| 3,424,455 | A | 1/1969 | Dunson | |
| 3,442,045 | A * | 5/1969 | Green | 446/297 |
| 3,559,989 | A * | 2/1971 | Breslow | 273/450 |
| 3,675,920 | A | 7/1972 | Gorman | |
| 3,717,340 | A | 2/1973 | Bowers | |
| 3,764,134 | A | 10/1973 | Reinertsen | |
| 4,117,455 | A * | 9/1978 | Cervantes | 340/908 |
| 4,354,682 | A | 10/1982 | Veala | |
| 4,522,403 | A | 6/1985 | Maciorowski | |
| 4,589,664 | A | 5/1986 | Slimp, Jr. | |
| 4,708,342 | A | 11/1987 | Davis | |
| 4,739,302 | A * | 4/1988 | Kinard | 340/908.1 |
| 4,854,587 | A * | 8/1989 | Groves | 473/417 |
| 4,932,655 | A | 6/1990 | Kurita | |
| 6,217,408 | B1 * | 4/2001 | Willinger | 446/396 |
| D448,423 | S | 9/2001 | Snowden | |
| 6,530,815 | B1 * | 3/2003 | Bro et al. | 446/15 |
| 6,612,943 | B2 * | 9/2003 | Beers | 473/451 |
| 6,644,493 | B1 * | 11/2003 | Walton et al. | 220/603 |
| 6,776,303 | B2 * | 8/2004 | Fripps | 220/603 |
| D546,983 | S | 7/2007 | Seidenberg | |
| 2009/0200743 | A1 * | 8/2009 | Gray | 273/450 |

* cited by examiner

*Primary Examiner* — Raleigh W. Chiu
(74) *Attorney, Agent, or Firm* — Neustel Law Offices

(57) ABSTRACT

A wobbling game system for providing an interactive and challenging game. The wobbling game system generally includes an apparatus for determining an outcome of a game, comprising a base including a curved portion and a flat portion, wherein the flat portion is positioned at a lowermost end of the base and wherein the curved portion extends from the flat portion. At least one ballast is positioned proximate the base or adding weight to the base and an adjustable counterbalance mechanism extends from the base for stabilizing the base on the flat portion. A plurality of games to use the apparatus with are also described herein.

19 Claims, 34 Drawing Sheets

10

WOBBLING GAME SYSTEM

CROSS REFERENCE TO RELATED APPLICATIONS

I hereby claim benefit under Title 35, United States Code, Section 120 of U.S. patent application Ser. No. 12/203,516 filed Sep. 3, 2008. This application is a continuation in-part of the Ser. No. 12/203,516 application filed Sep. 3, 2008. The Ser. No. 12/203,516 application is currently pending. The Ser. No. 12/203,516 application is hereby incorporated by reference into this application. The Ser. No. 12/203,516 application claimed benefit under Title 35, United States Code, Section 119(e) of U.S. provisional patent application Ser. No. 61/028,509 filed Feb. 13, 2008. The Ser. No. 61/028,509 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a game and more specifically it relates to a wobbling game system for providing an interactive and challenging game.

2. Description of the Related Art

Any discussion of the related art throughout the specification should in no way be considered as an admission that such related art is widely known or forms part of common general knowledge in the field.

Games of various styles and playing configurations have been in use for years. Different types of games may consist of electronic games, board games, or others. An element of limitation associated with many games today is the amount realism associated with the game. Often times, the games are rather two dimensional and involve apparatuses that offer very little in relation to the purpose of the games itself. This downfall can lead to player's dissatisfaction with the game and possibly cause the players to quickly lose interest in the game.

The present invention more particularly relates to balancing games. Balancing games in the prior art do not have a self-righting or balance cycle similar to the present invention. Because of the inherent problems with the related art, there is a need for a new and improved wobbling game system for providing an interactive and challenging game.

BRIEF SUMMARY OF THE INVENTION

The general purpose of the present invention is to provide a wobbling game system that has many of the advantages of the games mentioned heretofore. The invention generally relates to a game that includes an apparatus for determining an outcome of a game, comprising a base including a curved portion and a flat portion, wherein the flat portion is positioned at a lowermost end of the base and wherein the curved portion extends from the flat portion. At least one ballast is positioned proximate the base or adding weight to the base and an adjustable counterbalance mechanism extends from the base for stabilizing the base on the flat portion. A plurality of games to use the apparatus with are also described herein.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a wobbling game system for providing an interactive and challenging game.

Another object is to provide a wobbling game system that may provide for multiple types of games that incorporate various possible outcomes of the wobbling game, such as the direction in which the wobbling apparatus is pointing, amount by which the apparatus is tilted to the vertical, or the time required to balance.

An additional object is to provide a wobbling game system that offers a realism aspect and three dimensional playing apparatus to better immerse the player in the game.

A further object is to provide a wobbling game system that offers various types of fantasy playing configurations, such as being configured of a ship and using treasure to balance the ship.

Another object is to provide a wobbling game system that may be utilized as an alterable hour glass to offer exciting alternatives to timed games.

Another object is to provide a wobbling game system that includes a self-righting or balance cycle.

Another object is to provide a wobbling game system that allows alterability of the self-righting and balance cycle by interchanging the weights, adjusting the position of the ballast, or adjusting the height of the vertical extension.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

I. Display Embodiment

A. Overview

Figure 1:
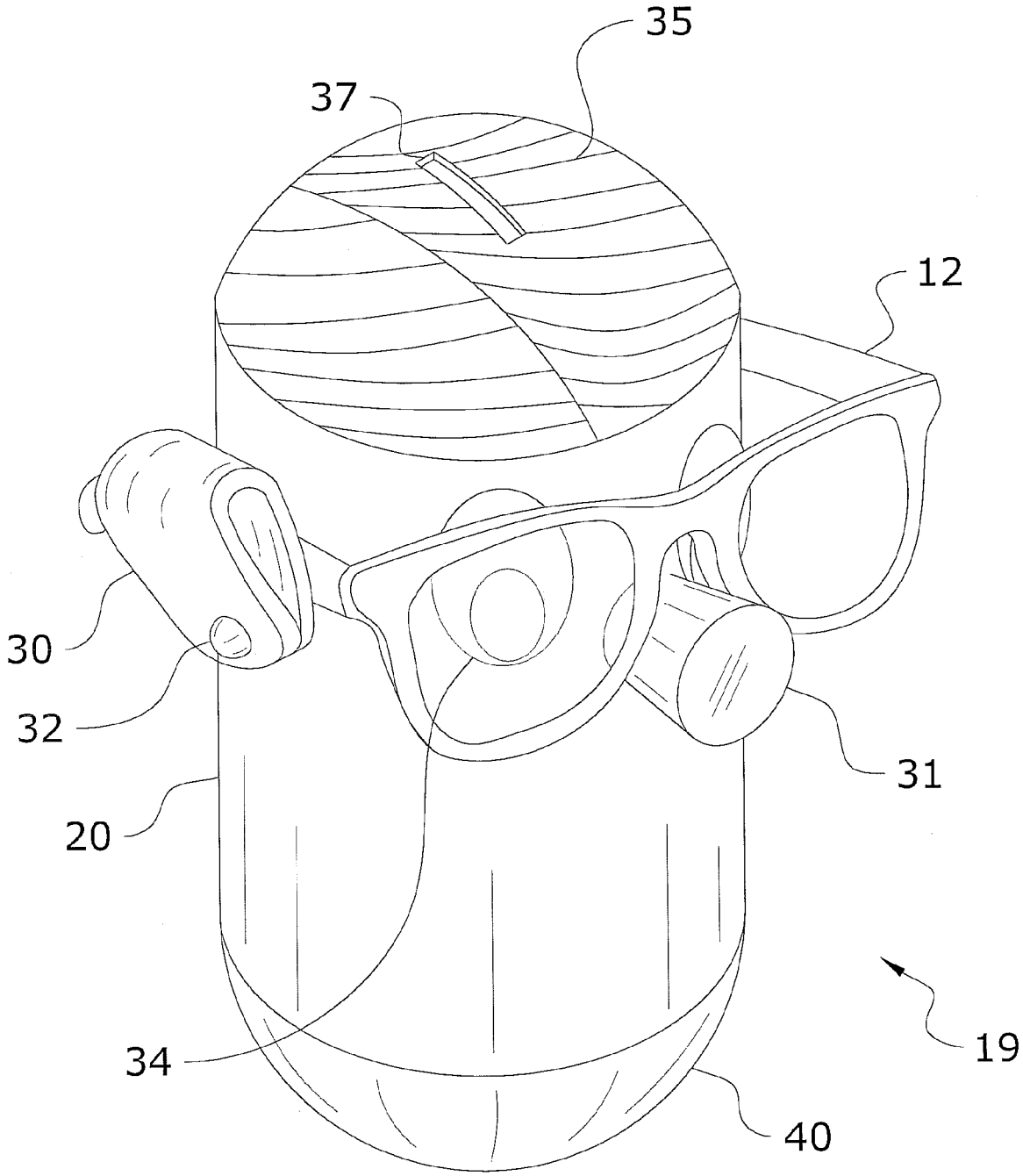
FIG. 1 is an upper perspective view of the present invention securing a pair of eyeglasses.

Turning now descriptively to the drawings, in which similar reference characters denote similar elements throughout the several views, FIGS. 1 through 15 illustrate a wobbling display system, which comprises a display item 12 (e.g. eyeglasses, etc.), a container 19 for securing the display item 12 to an external surface of the container 19, wherein the container 19 includes an upper section 20 and a lower section 40, wherein the lower section 40 includes a curved portion 41 curving downwardly and leading towards a flat portion 42, wherein the flat portion 42 extends along an extreme lower end of the lower section 40. An internal cavity extends within the upper section 20 and the lower section 40 of the container 19 to receive the display item 12 during storage and to house both ballast 14 and a counterbalance mechanism 50. The ballast 14 is positioned within the lower section 40 of the container 19 to maintain the container 19 in an upright position and the counterbalancing mechanism is positioned within the container 19 to counteract a weight placed upon the external surface of the container 19 by the display item 12.

B. Container

The present invention includes a container 19, which preferably includes an upper section 20 and a removable lower section 40, which will be described subsequently. The container 19 also includes an internal volume, which is divided up into an upper internal cavity 21, a lower internal cavity 43 and preferably a middle cavity between the upper and the lower. The upper section 20 and the lower section 40 are preferably comprised of similar materials and a configuration to evenly attach.

C. Upper Section

The upper section 20 of the present invention is preferably comprised of substantially cylindrical shaped configuration with a dome shaped upper portion to resemble a head of a character, individual or other creature. The upper section 20 and the various elements of the upper section 20 may be comprised of various lightweight materials suitable to allow the upper section 20 to be self-righted by the lower section 40, such as but not limited to plastic, wood or metal and in clear or other color materials.

The upper section 20 includes an upper internal cavity 21 extending within the upper section 20 from a lower end of the upper section 20. The upper internal cavity 21 is designed to both decrease the weight of the upper section 20 and to allow the upper section 20 to function as a container 19, wherein the display items 12, and various other removable parts (e.g. side supports 30, front supports 31, counterbalance mechanism 50) of the present invention may be stored within the upper internal cavity 21 when the present invention is not in use or during transport. The display item 12 in the case of eyeglasses may further be positioned within a pouch 13 within the upper internal cavity 21 and/or lower internal cavity 43 to keep the eyeglasses from being scratched or damaged. The upper section 20 may also include a coin slot 37, wherein the container 19 may function as a bank.

Along the lower end and lower perimeter of the upper section 20, a first interlocking portion 22 preferably circumscribes the upper section 20. The first interlocking portion 22 receives a second interlocking portion 44 of the lower section 40 to allow the upper section 20 to remain secured to the lower section 40, while allowing the upper section 20 to rotate about the lower section 40. In the preferred embodiment, the first interlocking portion 22 and the second interlocking portion 44 are recessed within the respective lower perimeter of the upper section 20 and upper perimeter of the lower section 40.

Figure 12:
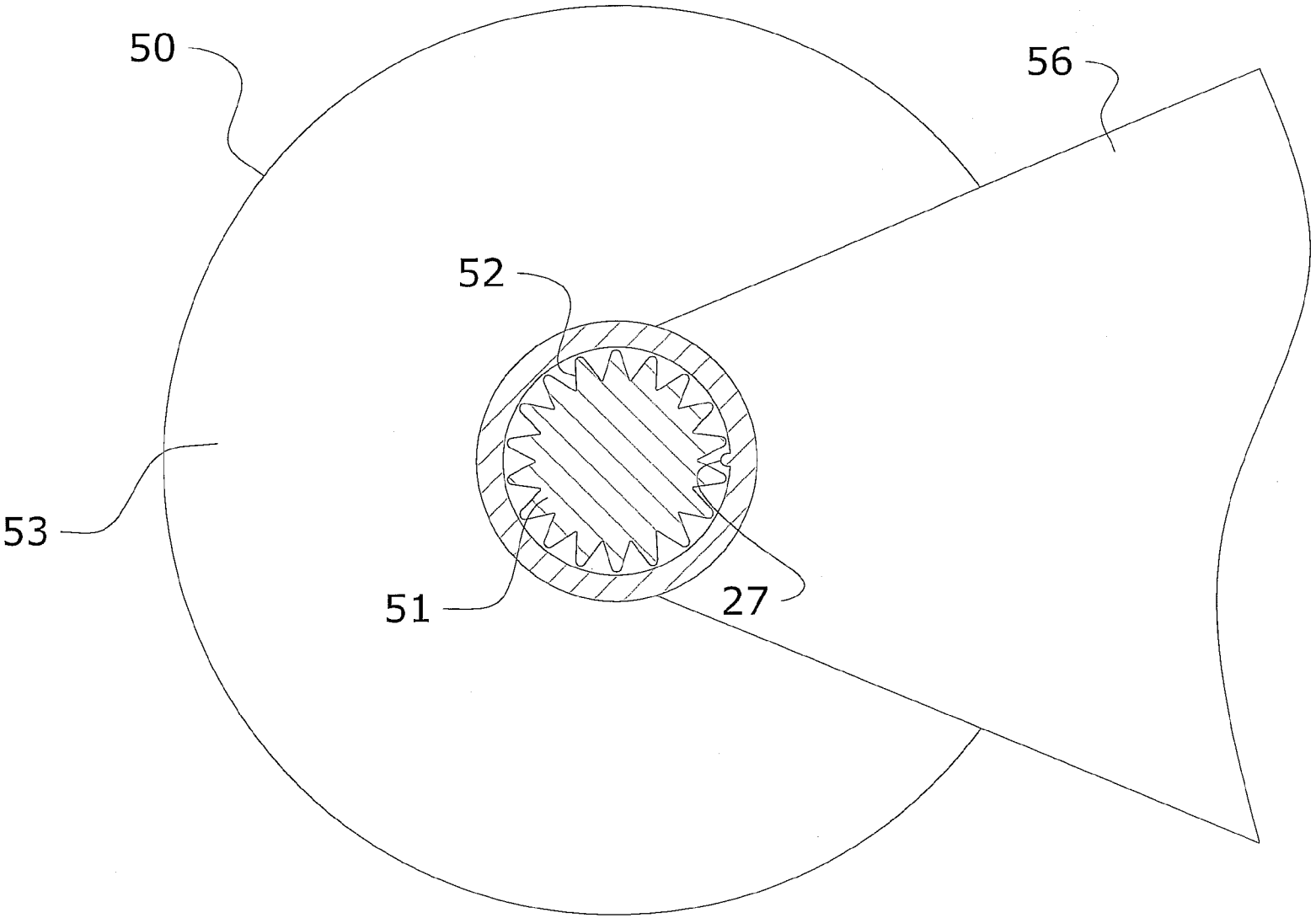
FIG. 12 is a top cross-sectional view of the ratcheting structure between the center post and the center aperture of the cross member.

A cross member 25 may also extend across the upper internal cavity 21 adjacent the lower end of the upper section 20. The cross member 25 may completely seal the upper internal cavity 21 from the lower end of the upper section 20 or may allow for a gap between the cross member 25 and the inner surface of the upper section 20 so as not seal the upper internal cavity 21. The cross member 25 includes a center aperture 26 to receive the center of the counterbalance mechanism 50 and an offset aperture to receive a point of the counterbalance mechanism 50 near the outer perimeter. A pawl 27 also slightly extends from the wing member 55 of the platform 56 to ensure that the counterbalance mechanism 50 rotates in a ratcheting manner with respect to the upper section 20 to maintain the counterbalance mechanism 50 in a set position as illustrated in FIG. 12.

Figure 2:
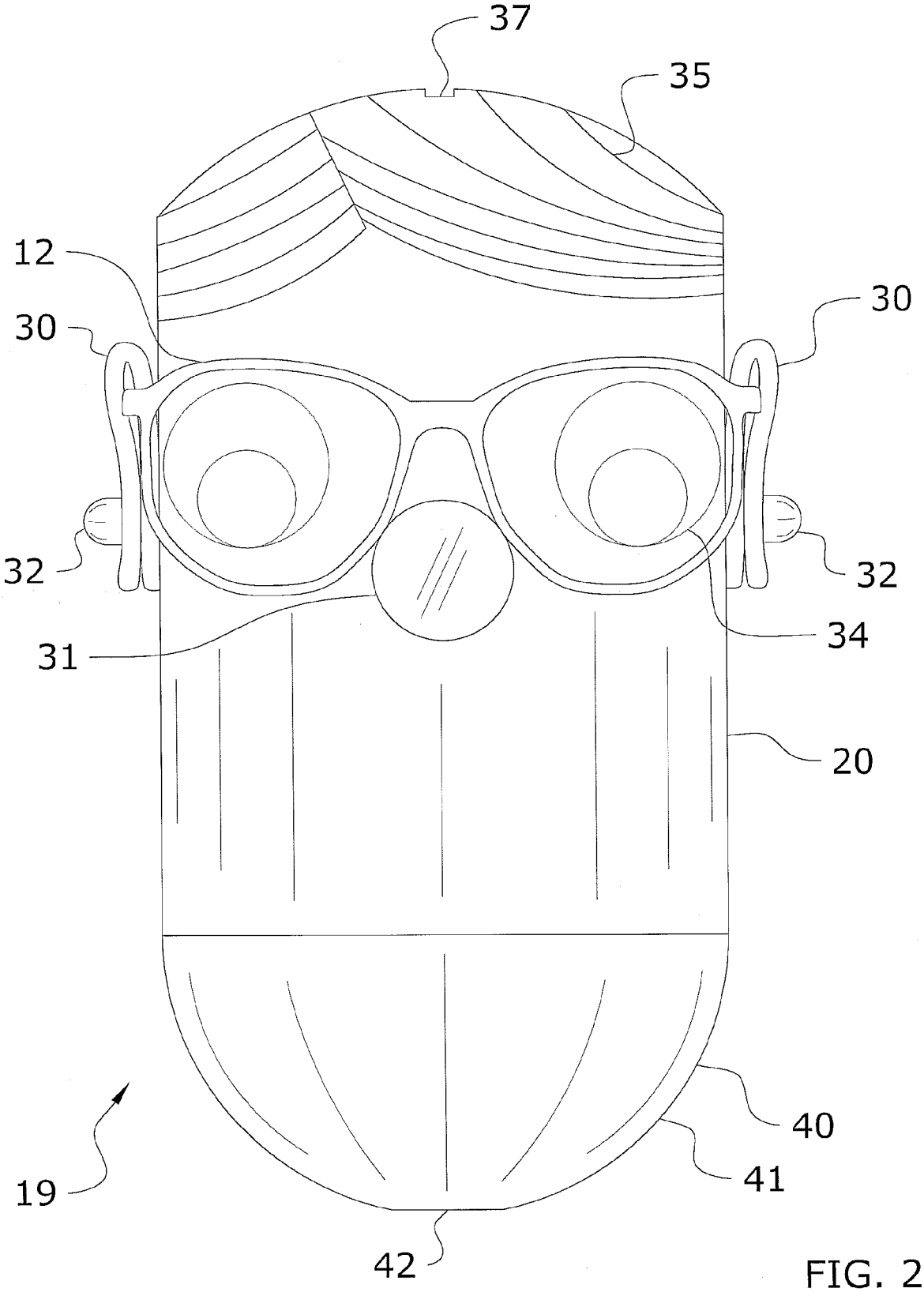
FIG. 2 is a front view of the present invention securing a pair of eyeglasses.
Figure 3:
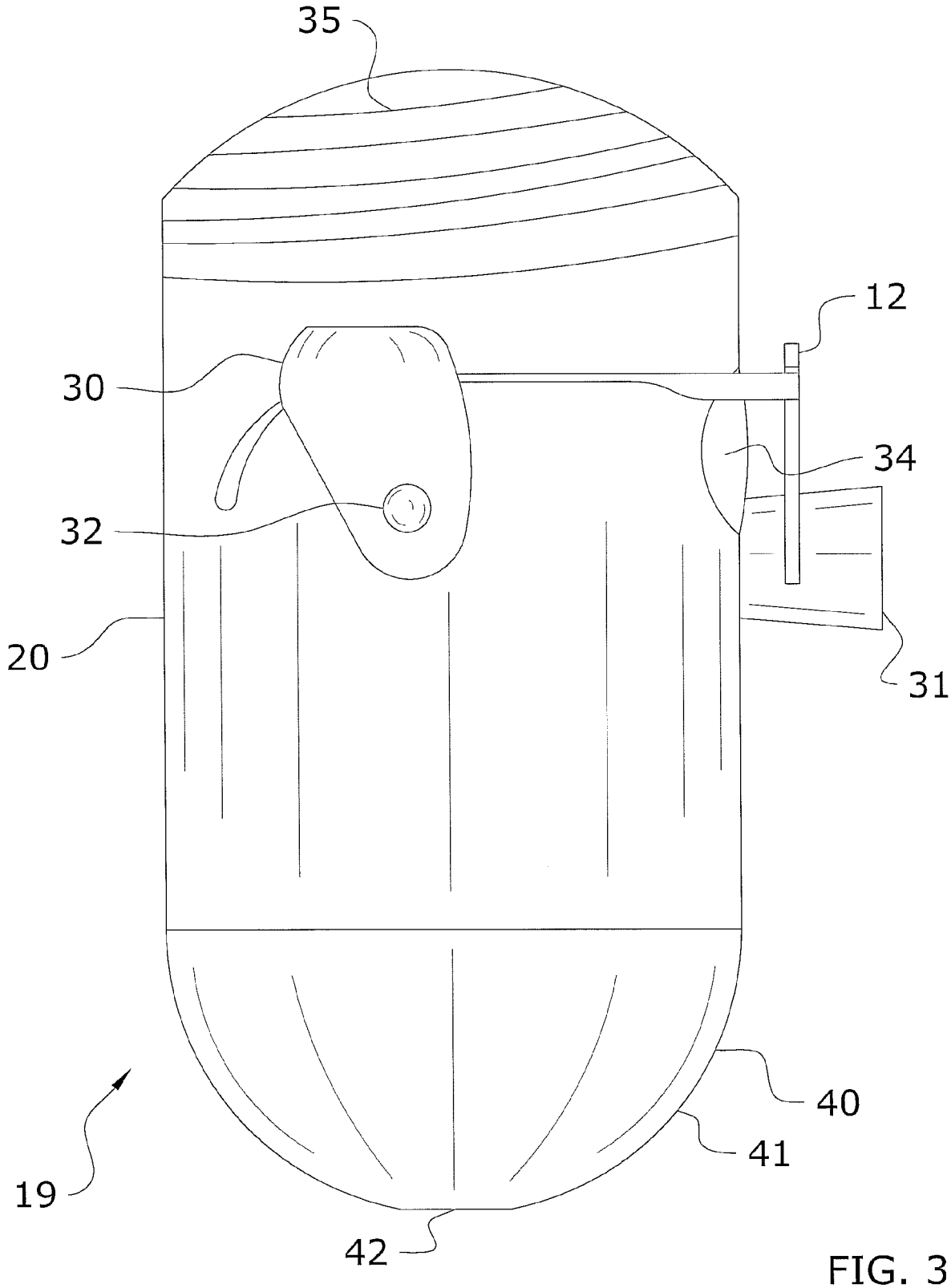
FIG. 3 is a side view of the present invention securing a pair of eyeglasses.
Figure 4:
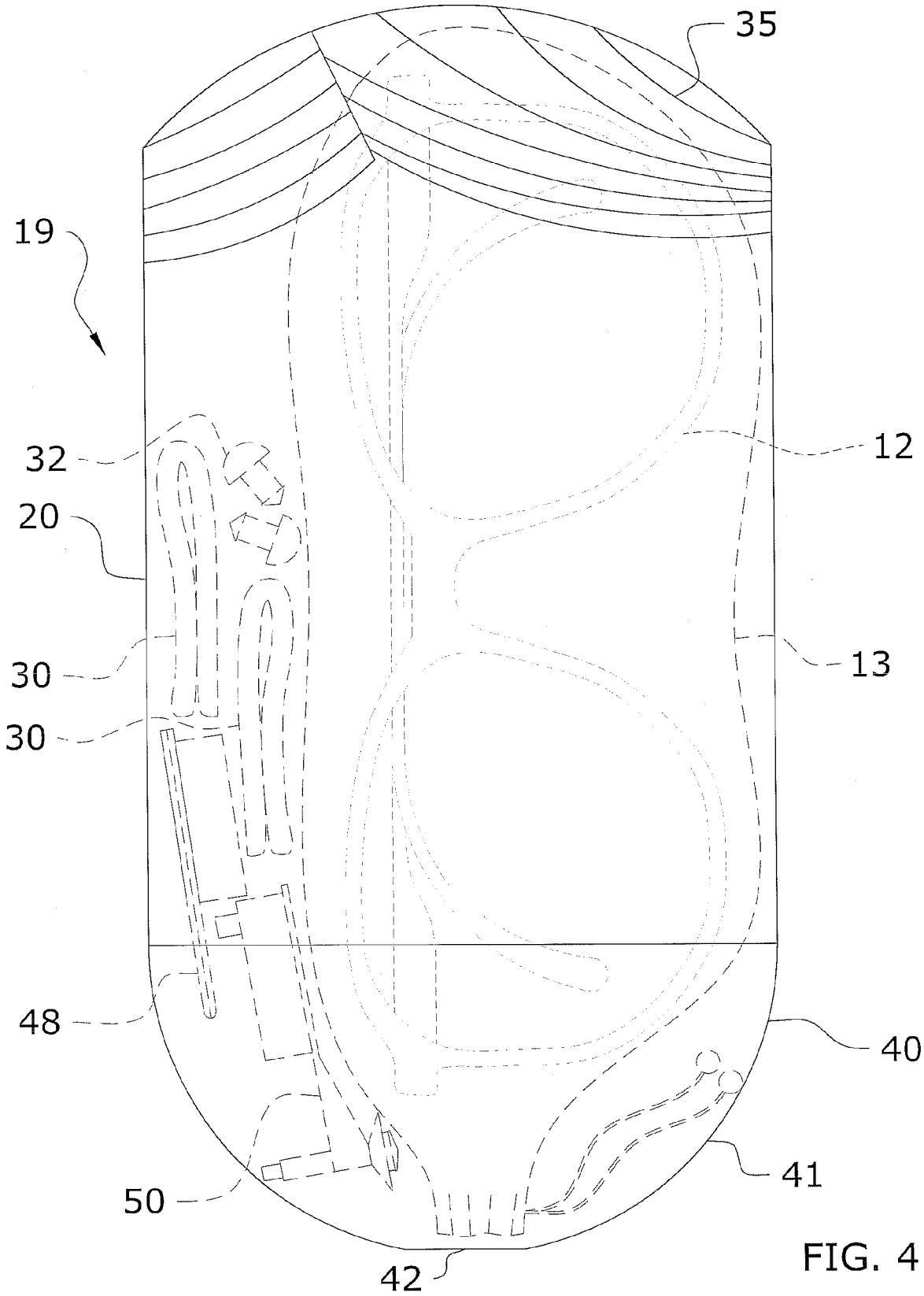
FIG. 4 is a front view of the present invention with all of the removable parts stored within the internal cavity of the container.
Figure 5:
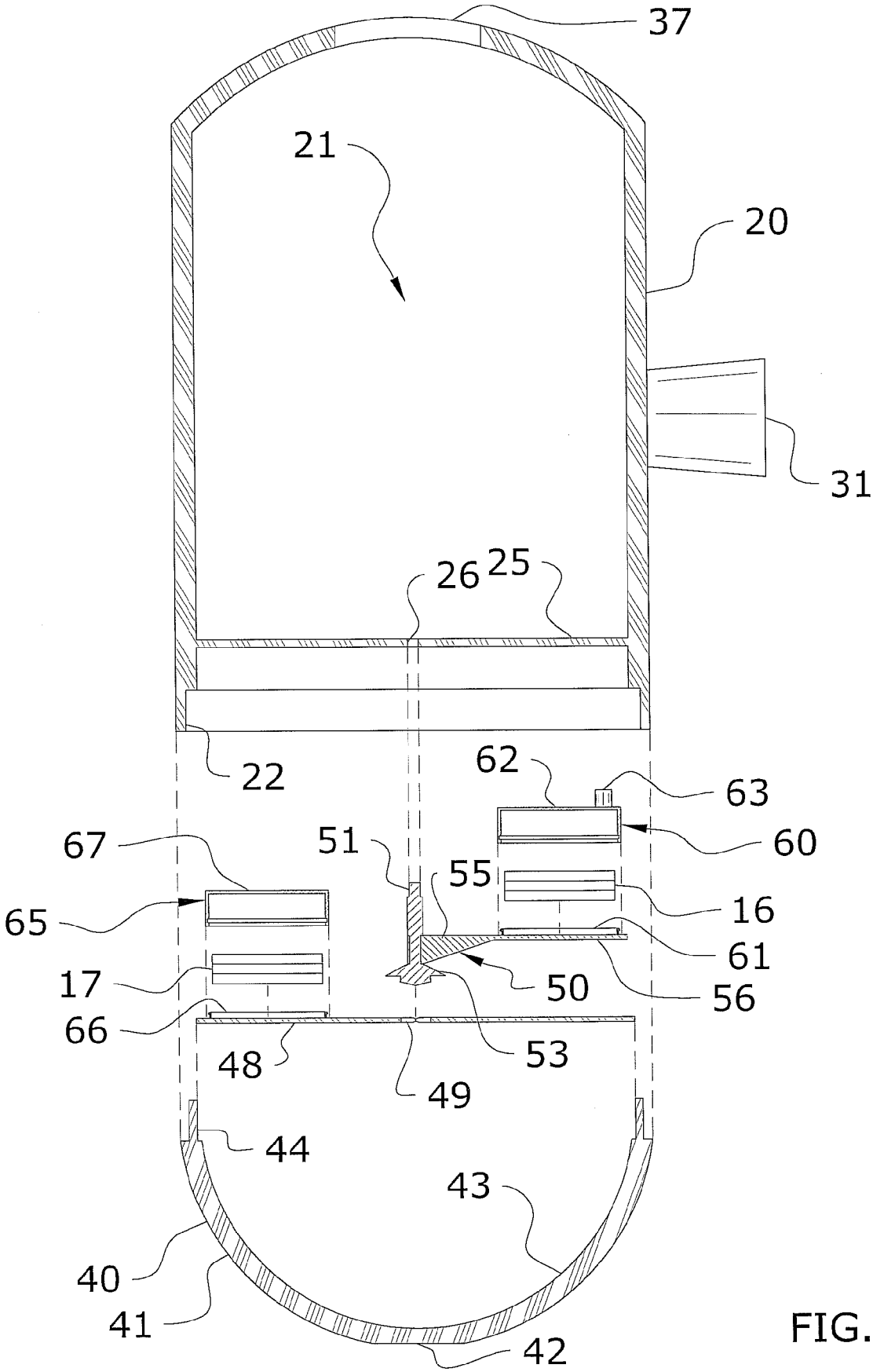
FIG. 5 is an exploded side cross-sectional view of the present invention.
Figure 6:
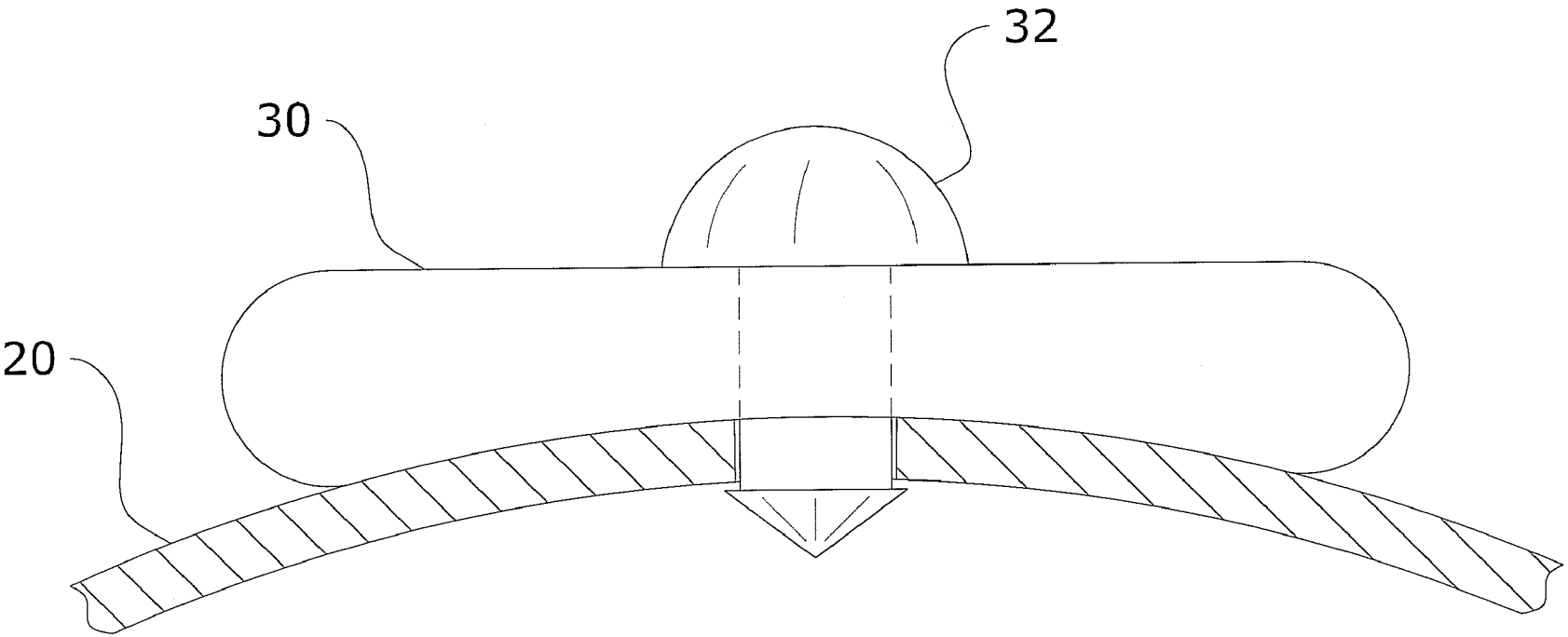
FIG. 6 is a magnified cross-sectional view of the side supports removable secured to the container via the retaining element.
Figure 7:
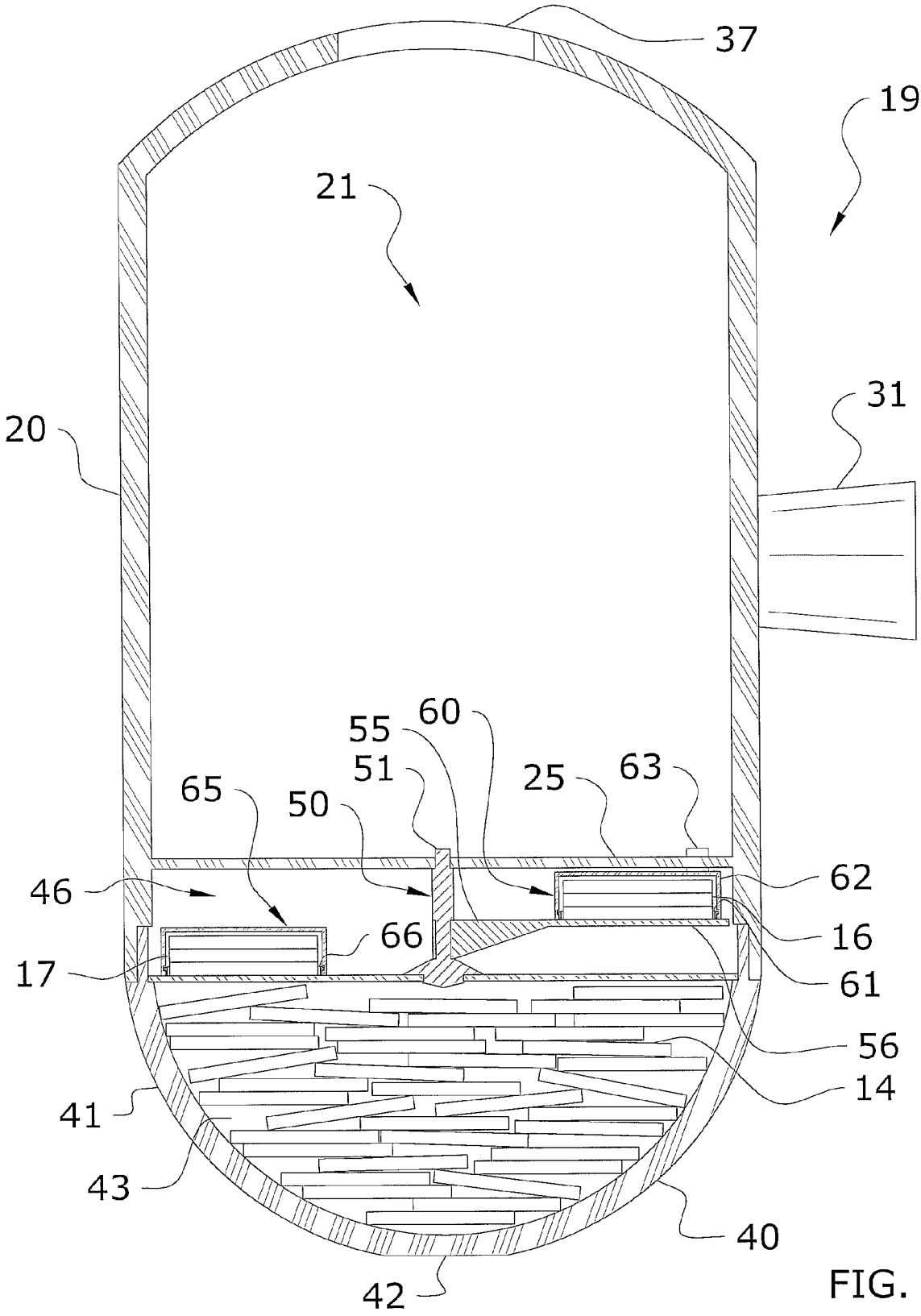
FIG. 7 is a side cross-sectional view of the present invention.
Figure 8:
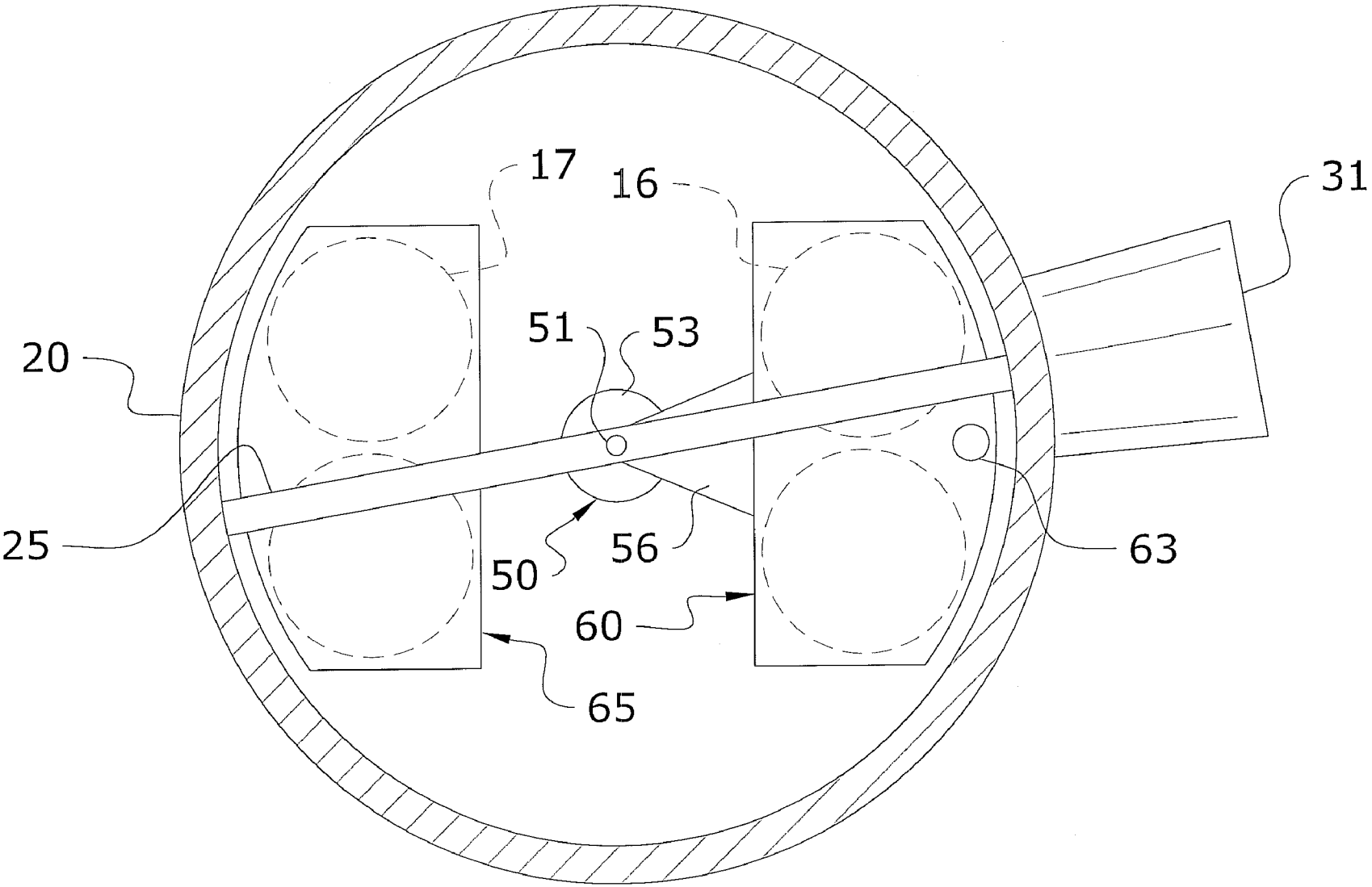
FIG. 8 is a top cross-sectional view of the present invention in an initial position.

The upper section 20 preferably includes a plurality of side supports 30 and front supports 31 to secure a display item 12 upon the external surface of the upper section 20. In the preferred embodiment, the side supports 30 resemble ears to hold the outer ends of an eyeglass frame and the front support 31 resembles a nose to hold the center of the eyeglass frame as illustrated in FIGS. 1 through 3. The side supports 30 of the preferred embodiment are constructed by folding a piece of material (e.g. cloth, foam, plastic) in half and securing the material to the side of the upper section 20.

The side supports 30 and front supports 31 may also be removable attached to the upper section 20 via a retaining element 32 extending through the upper section 20 and expanding outwards along the inner surface of the upper section 20 to prevent easy removal or falling out of the side supports 30 and front supports 31. The upper section 20 may thus include various openings extending through the upper section 20 to receive the retaining elements 32. The upper section 20 may also include hair 35 and eyes 34 to better resemble an individual or character. The hair 35 and eyes 34 may be drawn onto the external surface of the upper section 20 or may be comprised of removable pieces similar to the side supports 30 (ears) and front support 31 (nose).

D. Lower Section

The lower section 40 removably connects to the upper section 20 and provides the stabilizing part in which to support the upper section 20 in an upright manner. The lower section 40 is preferably comprised of a hemispherical shaped configuration. Along the external surface of the lower section 40, a curved portion 41 extends toward a lower end to meet up with a flat portion 42 upon the extreme bottom of the lower section 40. The curved portion 41 provides the structure in which to allow the lower section 40 to wobble or rock and the flat portion 42 provides the structure in which to keep the lower section 40 stabilized. The shape of the upper section 20 and the lower section 40 allow the present invention simply to lean over in a smooth manner rather than fall over in the case that the counterbalance mechanism 50 is not properly adjusted or the display item 12 is too heavy.

The lower section 40 includes a lower internal cavity 43 extending within the lower section 40 from an upper end of the lower section 40. The lower internal cavity 43 holds the ballast 14 within the lower section 40. The ballast 14 may be comprised of various fluid materials, such as but not limited to coins (e.g. nickels), sand, water, bb's, or any other element that may move along with the lower section 40 inside of the lower internal cavity 43 and provided a weighted structure in which to keep weight displaced over the flat portion 42 of the lower section 40.

A lower plate 48 also extends across the upper end of the lower section 40 above the lower internal cavity 43. The cross member 25 may completely seal the lower internal cavity 43 from the upper end of the lower section 40 or may allow for a gap between the lower plate 48 and the inner surface of the lower section 40 so as not seal the lower internal cavity 43. The lower plate 48 also includes a center aperture 49 to receive the counterbalance mechanism 50. The lower plate 48 may also be removable and foldable to fit within the upper internal cavity 21 during storage of the present invention.

The cross member 25 and the lower plate 48 define a middle internal cavity 46 between thereof. The middle internal cavity 46 is comprised of an open space in which to receive the counterbalance mechanism 50. The middle internal cavity 46 is preferably sealed or formed so as not to engage other objects within the upper internal cavity 21 of the upper section 20 or the lower internal cavity 43 of the lower section 40.

E. Counterbalance Mechanism

A counterbalance mechanism 50 is connected within the middle internal cavity 46 between the cross member 25 of the upper section 20 and the lower plate 48 of the lower section 40. The counterbalance mechanism 50 retains the present invention in an upright position and may be rotatably adjusted to accommodate for different weighted display items 12 placed upon the external surface of the upper section 20.

In the preferred embodiment, the counterbalance mechanism 50 includes a center post 51 connected between the center aperture 26 of the cross member 25 and the center aperture 49 of the lower plate 48. The center post 51 is preferably fixed in a non rotatable manner between the cross member 25 and the lower plate 48, wherein the counterbalance mechanism 50 and the upper section 20 rotates around the center post 51.

The center post 51 also includes a plurality of vertical ridges 52 extending parallel along a perimeter of the center post 51. The vertical ridges 52 individually receive the pawl 27, wherein the vertical ridges 52 and the pawl 27 function in a ratcheting manner to prevent the upper section 20 from continually spinning about the center post 51 and the lower section 40. The center post 51 may also include a lower support 53 along a lower end of the center post 51 to keep the center post 51 stabilized and positioned in a straight vertical manner with respect to the lower section 40. It is appreciated that the pawl 27 may be omitted and the upper section 20 and lower section 40 are simply frictionally fit together.

A wing member 55 extends perpendicularly outward from the center post 51. The wing member 55 is preferably rotatably attached to the center post 51. The wing member 55 includes a platform 56 extending from an outer end of the wing member 55. The platform 56 receives a movable case 60, which includes a plurality of movable weighted objects 16. The movable case 60 includes a lower part 61 and an upper part 62 in which the movable weighted objects 16 are sealed between to keep the movable weighted objects 16 from moving off of the platform 56.

The movable weighted objects 16 may be comprised of various configurations, all which may provide a weight heavy enough to counterbalance the display item 12 that is supported from the external surface of the upper section 20. In the preferred embodiment, the movable weighted objects 16 are comprised of coins; however it is appreciated that various other embodiments may be used.

Figure 9:
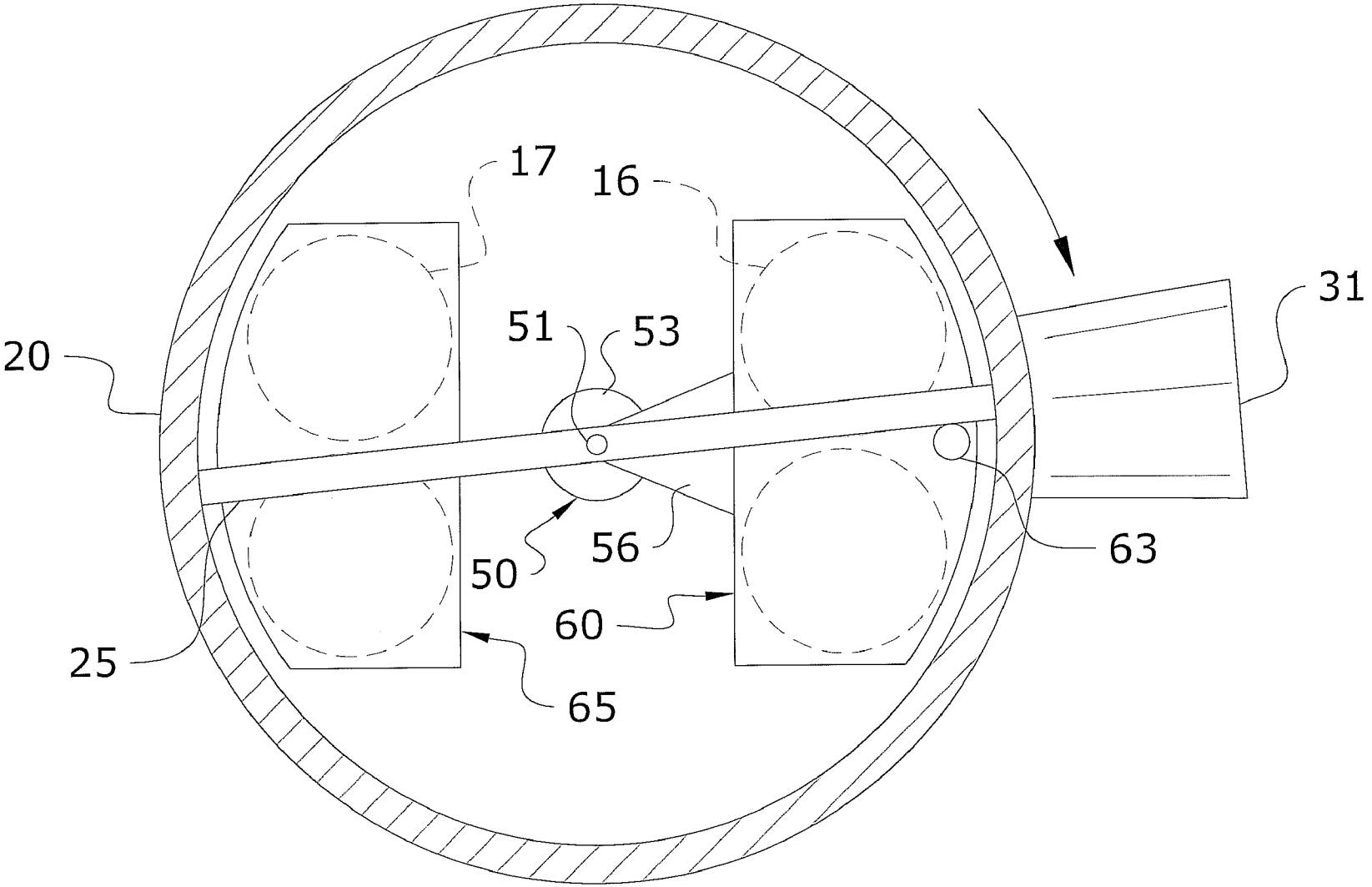
FIG. 9 is a top cross-sectional view of the present invention with the upper section being rotated so that the cross member engages the engaging member of the counterbalance mechanism.
Figure 10:
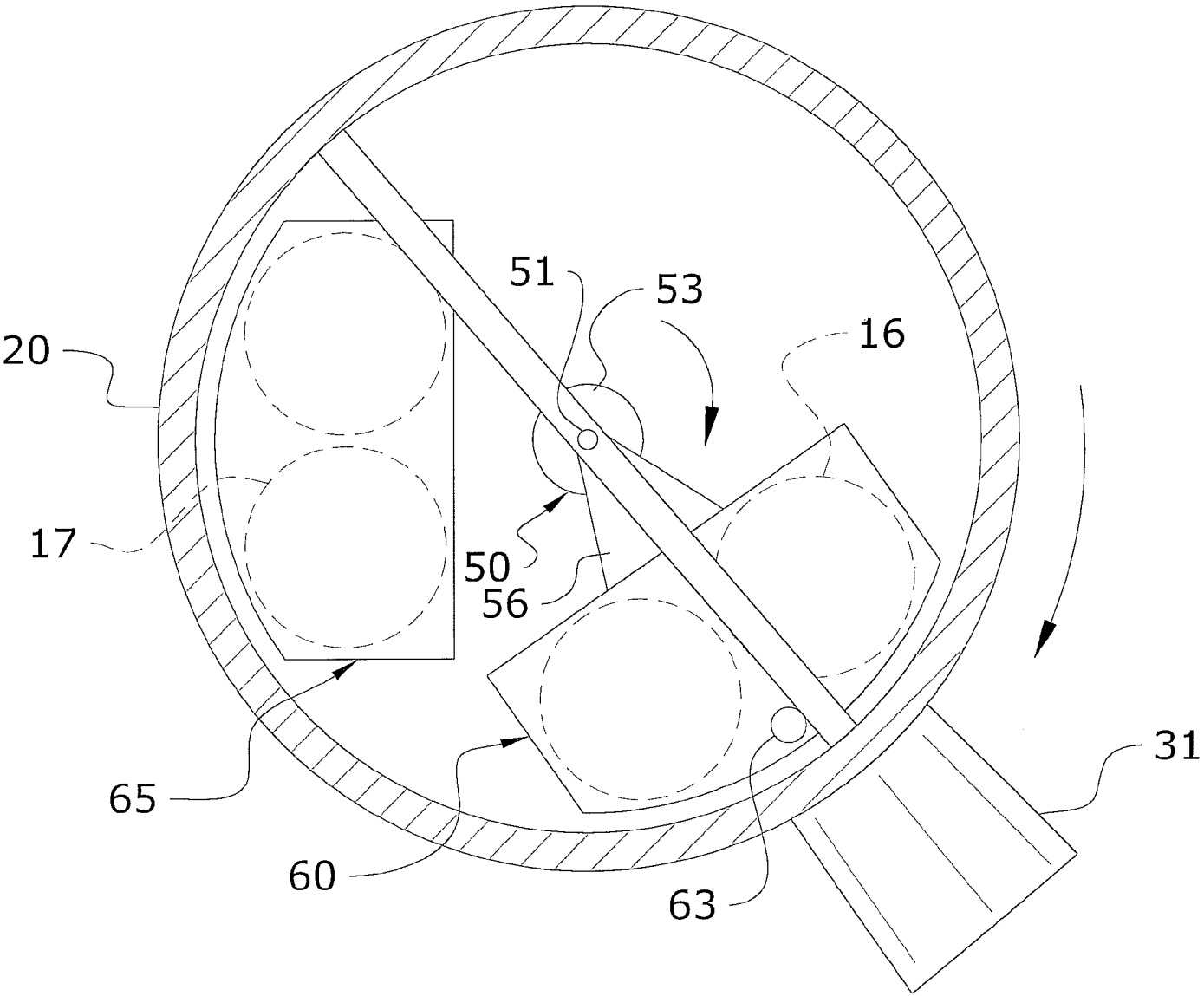
FIG. 10 is a top cross-sectional view of the present invention with the upper section being rotated further so that the cross member engages the engaging member of the counterbalance mechanism and rotates the movable weighted objects of the counterbalance mechanism.
Figure 11:
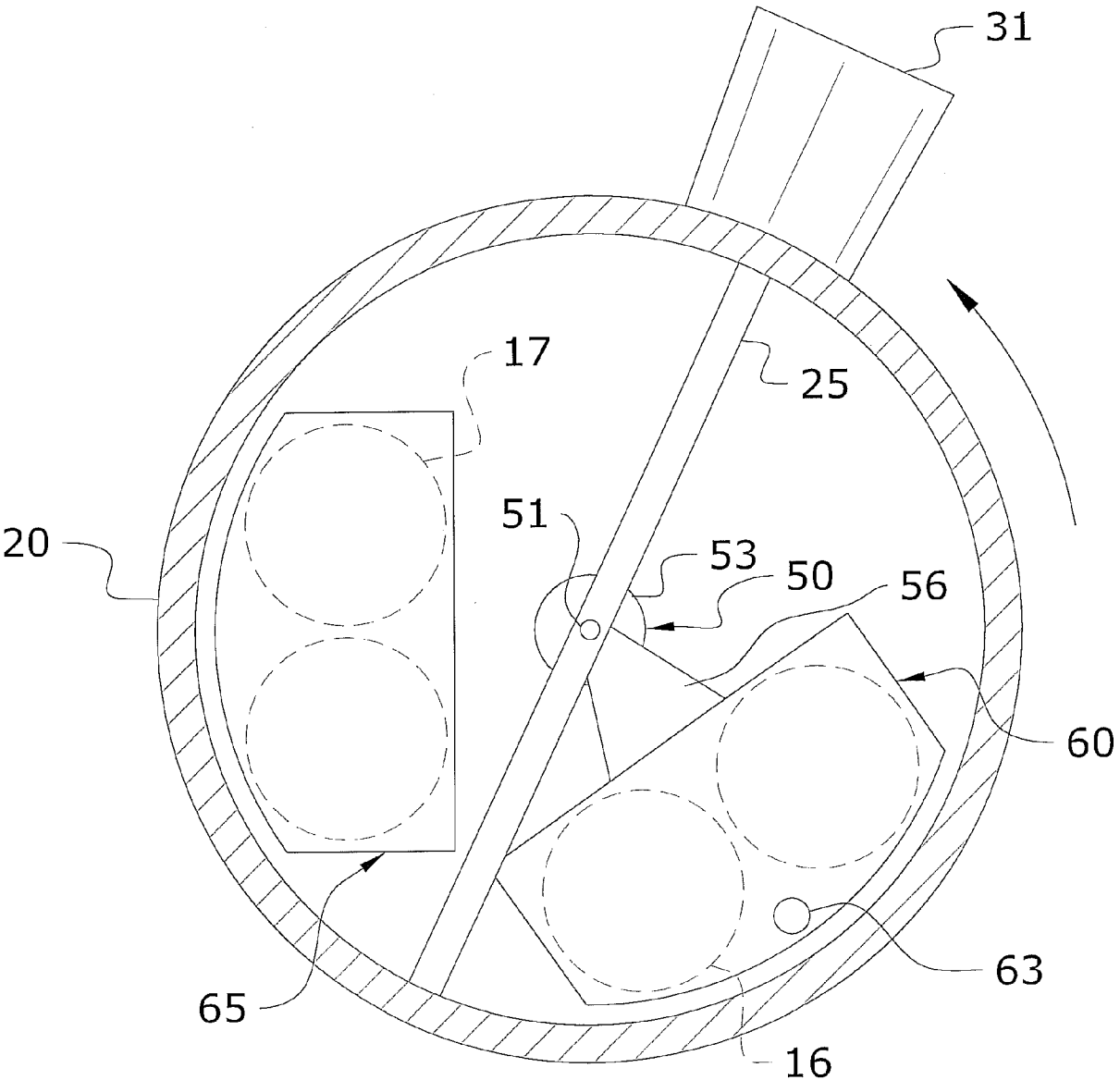
FIG. 11 is a top cross-sectional view of the present invention with the upper section being rotated in an opposite direction to leave the movable weighted objects near the rear side of the container and move the nose (front support) towards the front side of the container.

An engaging member 63 preferably extends upward from the movable case 60 to either engage the cross member 25 or extend within the offset aperture of the cross member 25. This allows the rotation of the movable case 60 along with the rotation of the upper section 20 when the user rotates the upper section 20. It is appreciated that the engaging member 63 may simply be pushed by the cross member 25 so as to allow the upper section 20 to freely swing in an opposing direction away from the movable case 60 in a reverse direction as illustrated in FIG. 11 and to push the movable case 60 via engaging the engaging member 63 as illustrated in FIGS. 9 and 10.

A stationary case 65 is also preferably fixedly attached to the lower plate 48 at an opposite side of the lower section 40 within the middle internal cavity 46 with respect to the movable case 60 when no display items 12 are supported upon the external surface of the upper section 20. The stationary case 65 is further positioned at a rearward side of the present invention with respect to the front support 31 (i.e. nose), eyes 34, hair 35 and side supports 30 (i.e. ears). When a display item 12 is supported upon the front side of the upper section 20, the movable case 60 and wing member 55 are adjusted towards the stationary case 65 to increase the weight upon the rearward side and thus accommodate for the weight of the display device upon the front side.

The stationary case 65 also includes a lower part 66 and upper part 67 similar to the movable case 60. The stationary case 65 also secures a plurality of stationary weighted objects 17 (e.g. coins) within, wherein the stationary weighted objects 17 are preferably similar in weight and size to the movable weighted objects 16.

F. Operation of Display Embodiment

In use, the assembled present invention is stood upright with the lower internal cavity 43 including the ballast 14 and the movable case 60 and the stationary case 65 including the movable weighted objects 16 and the stationary weighted objects 17. The horizontal center of mass of the present invention is to be located directly over the flat portion 42 to allow the present invention to stay at equilibrium in an upright and consistent position. The display item 12 (e.g. eyeglasses, rings, IPOD NANO, pens, candles, etc.) is positioned upon an external surface of the upper section 20 and supported by the side supports 30 and front support 31. The curved portion 41 of the lower section 40 is heavy enough to maintain the center of mass within the lower section 40 when the display item 12 is placed upon the upper section 20, which keeps the present invention from toppling over.

When the display item 12 is placed on the upper section 20, the horizontal center of mass will shift in the direction of the externally placed display item 12 and tip the present invention over. The counterbalance mechanism 50 is twisted to counteract the tipping over of the present invention. The counterbalance mechanism 50 may be adjusted to move the present invention to a more upright position by twisting the upper section 20, which in turn twists the wing member 55 and movable weighted objects 16 within the movable case 60 relative to the stationary weighted objects 17 within the stationary case 65. This results in both the movable weighted objects 16 and the stationary weighted objects 17 being positioned on one side of the lower section 40 (i.e. opposite the display item 12).

Once the counterbalance mechanism 50 is properly adjusted, an external force may be applied to the outside of the present invention causing the lower section 40 to wobble and eventually return to a stabilized position. If desired, an electric motor may be positioned within the lower section 40 to initiate a wobbling motion. A suction cup may also be affixed to the lower end of the base to stabilize the present invention upon a tabletop or dashboard of a vehicle. The suction cup may alleviate the need for the ballast 14 or weighted objects.

G. Cup Embodiment

Figure 13:
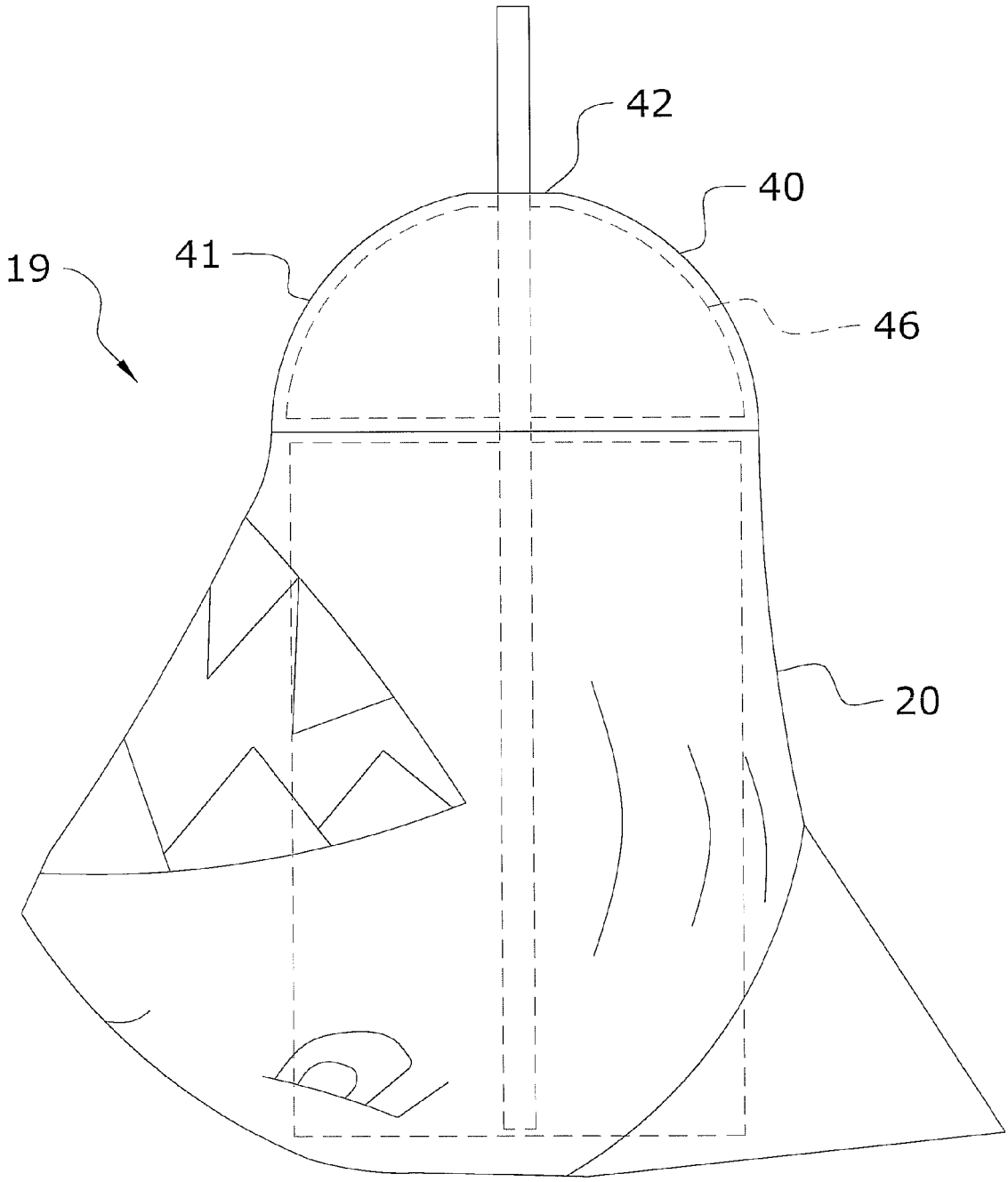
FIG. 13 is a side view of an alternate embodiment of the present invention, wherein the container is comprised of a drinking cup configuration.

In an alternate embodiment, the present invention may be comprised of a cup configuration as illustrated in FIG. 13. The upper section 20 of the cup may include a caricature that may be asymmetrically positioned or symmetrically positioned with respect to the center of the upper section 20. The cup embodiment may include or not include the counterbalancing mechanism. The upper internal cavity 21 of the upper section 20 in the cup embodiment is sealed at a lower end to hold a liquid. The upper end of the upper section 20 may also include an opening to receive a straw in which to drink the liquid from the upper internal cavity 21.

H. Sailboat Embodiment

Figure 14:
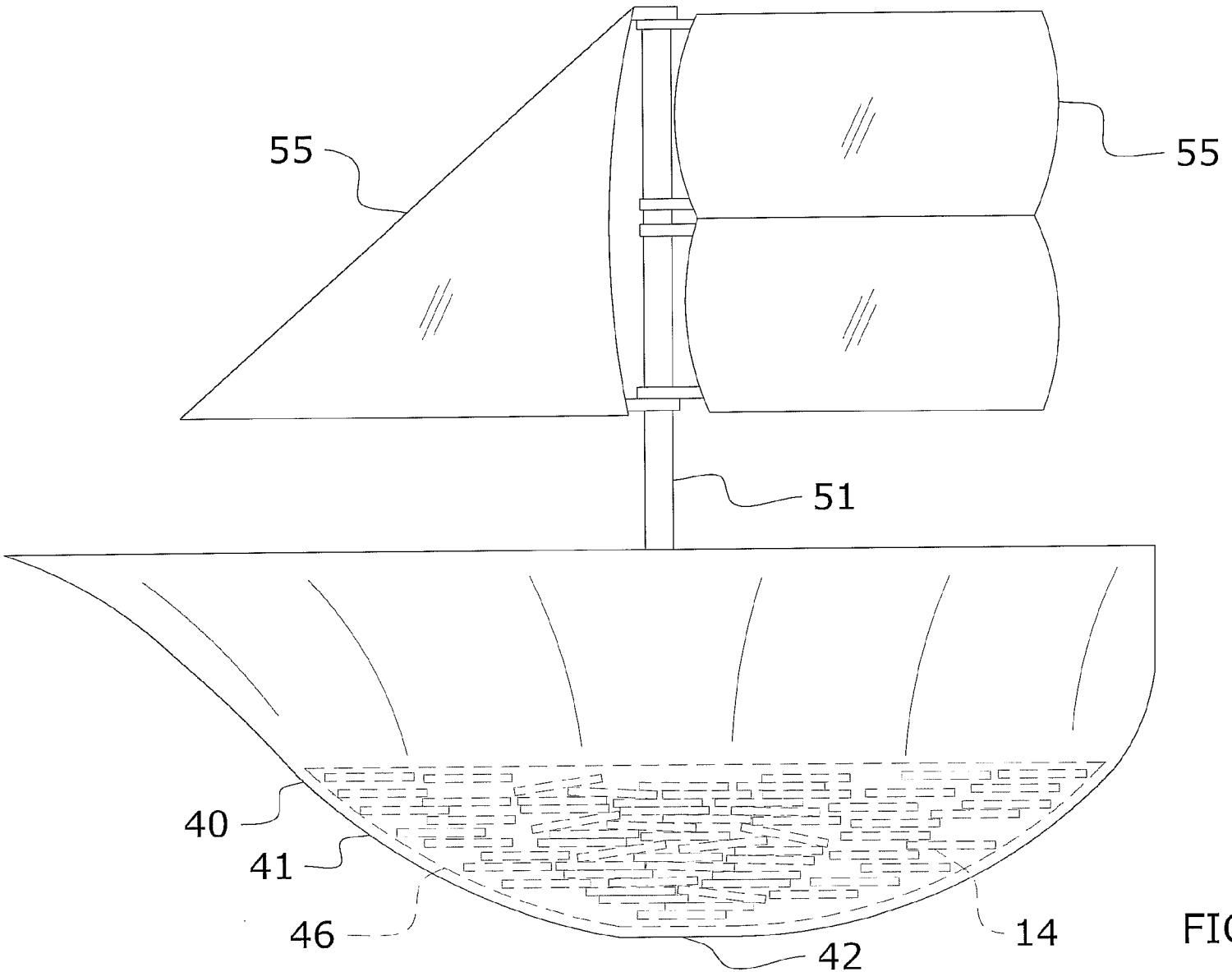
FIG. 14 is a side view of another embodiment of the present invention, wherein the container is comprised of a sailboat configuration.
Figure 15:
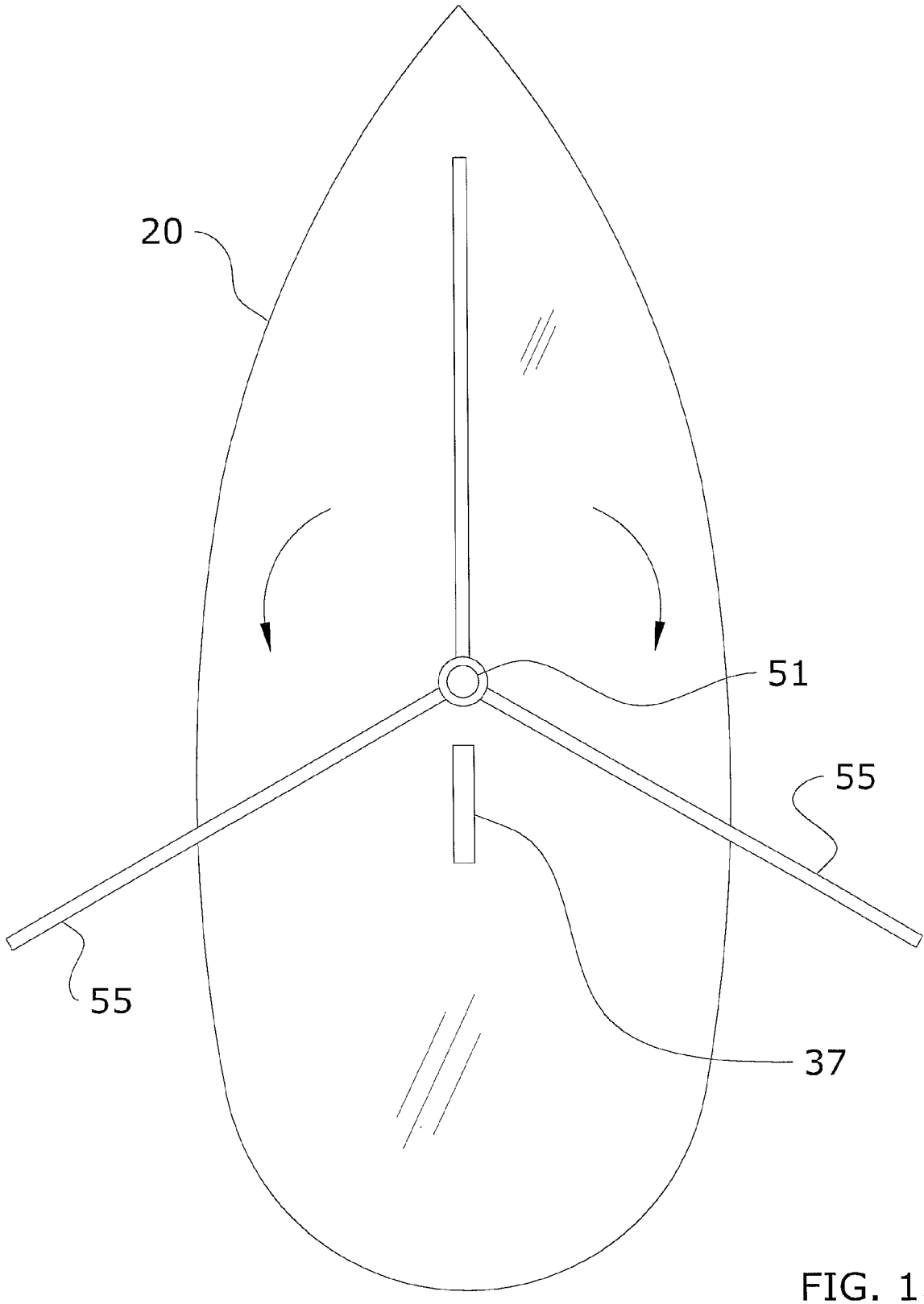
FIG. 15 is a top view of the other alternate embodiment of the present invention illustrating the sails being rotated to counterbalance the weight placed upon the hull.
Figure 16:
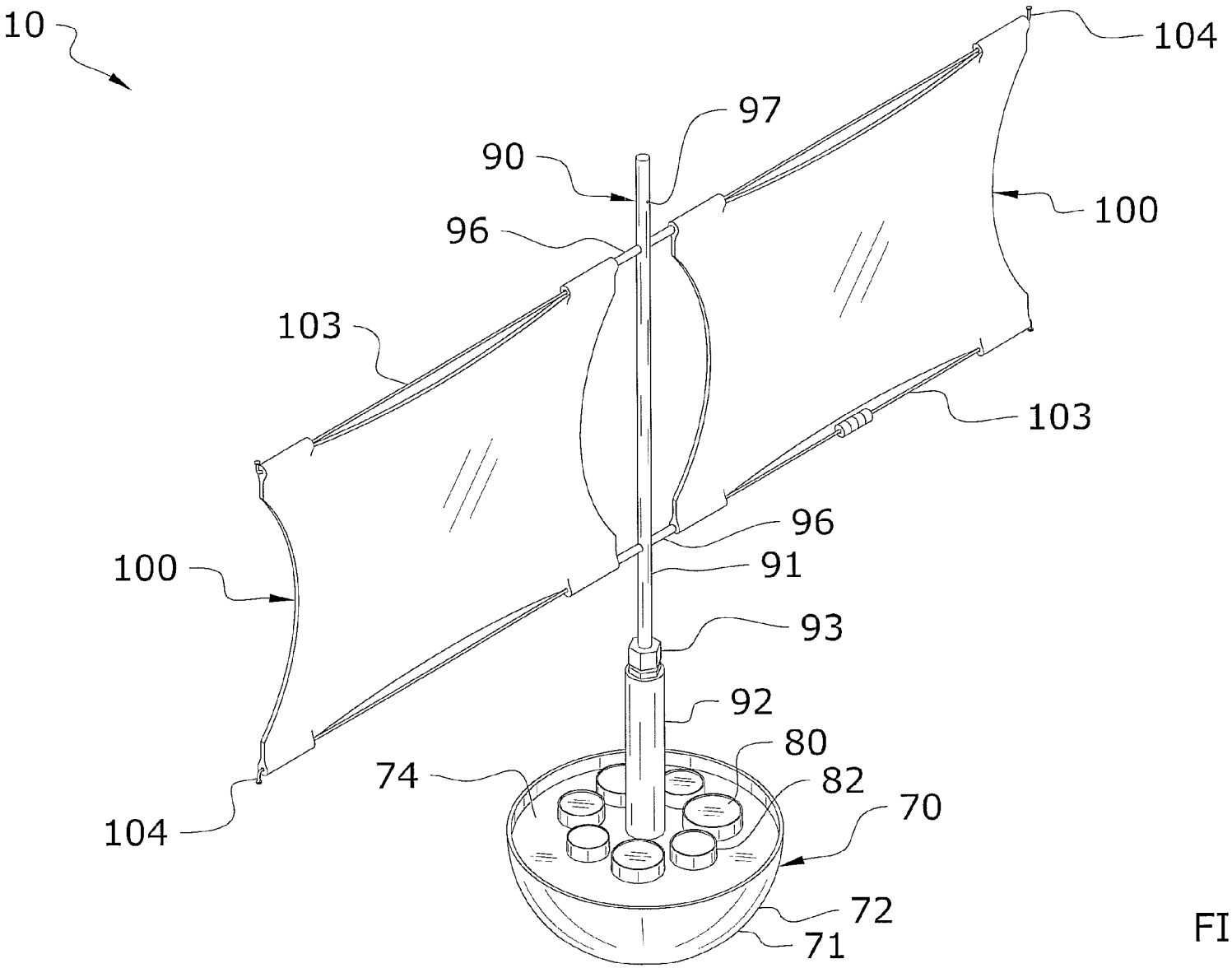
FIG. 16 is an upper perspective view of the apparatus in the first game embodiment.
Figure 17:
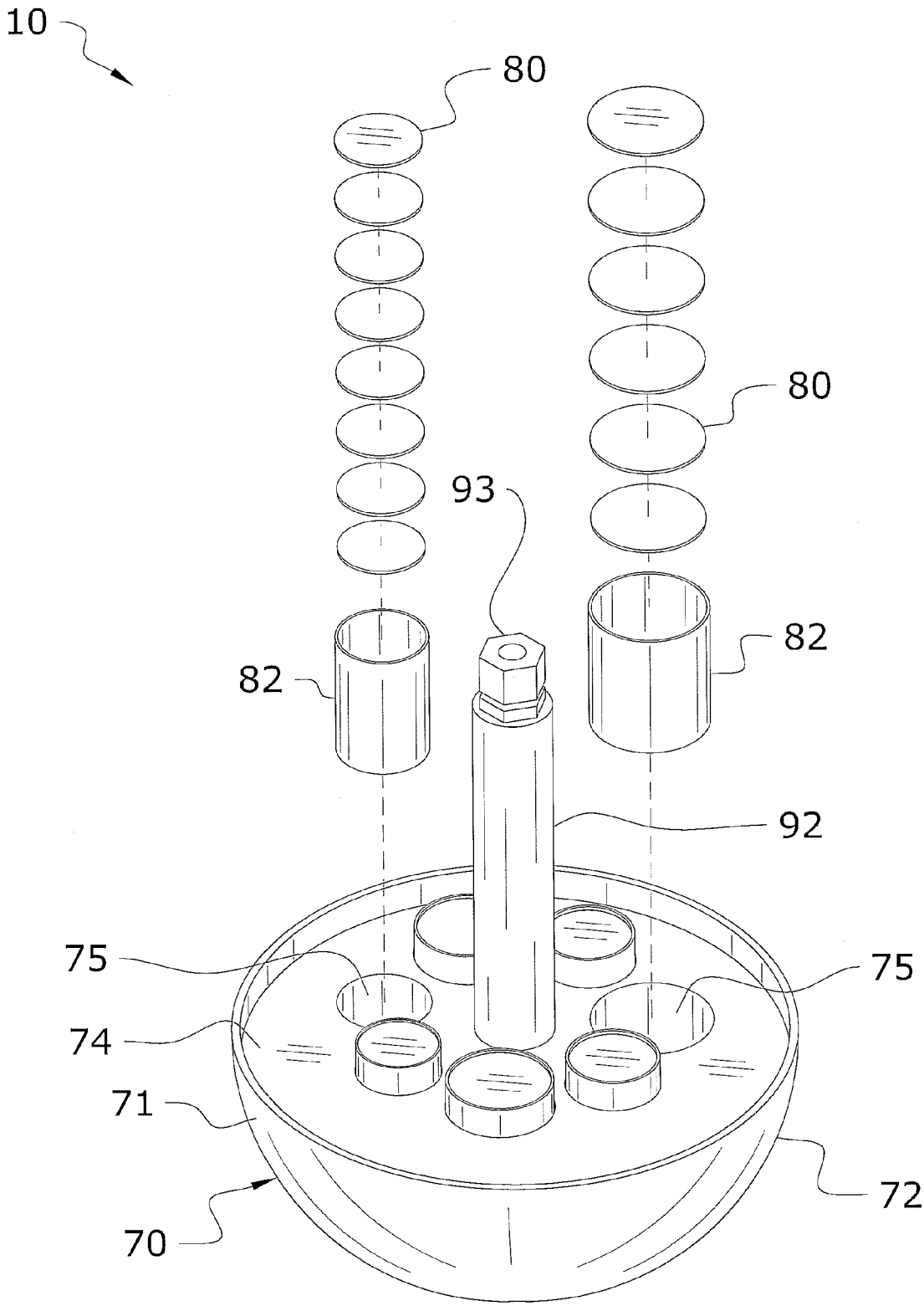
FIG. 17 is an upper perspective view of the apparatus in the first game embodiment with the vertical extension lowered and the first weighted objects and retainer cups exploded from the base.
Figure 18:
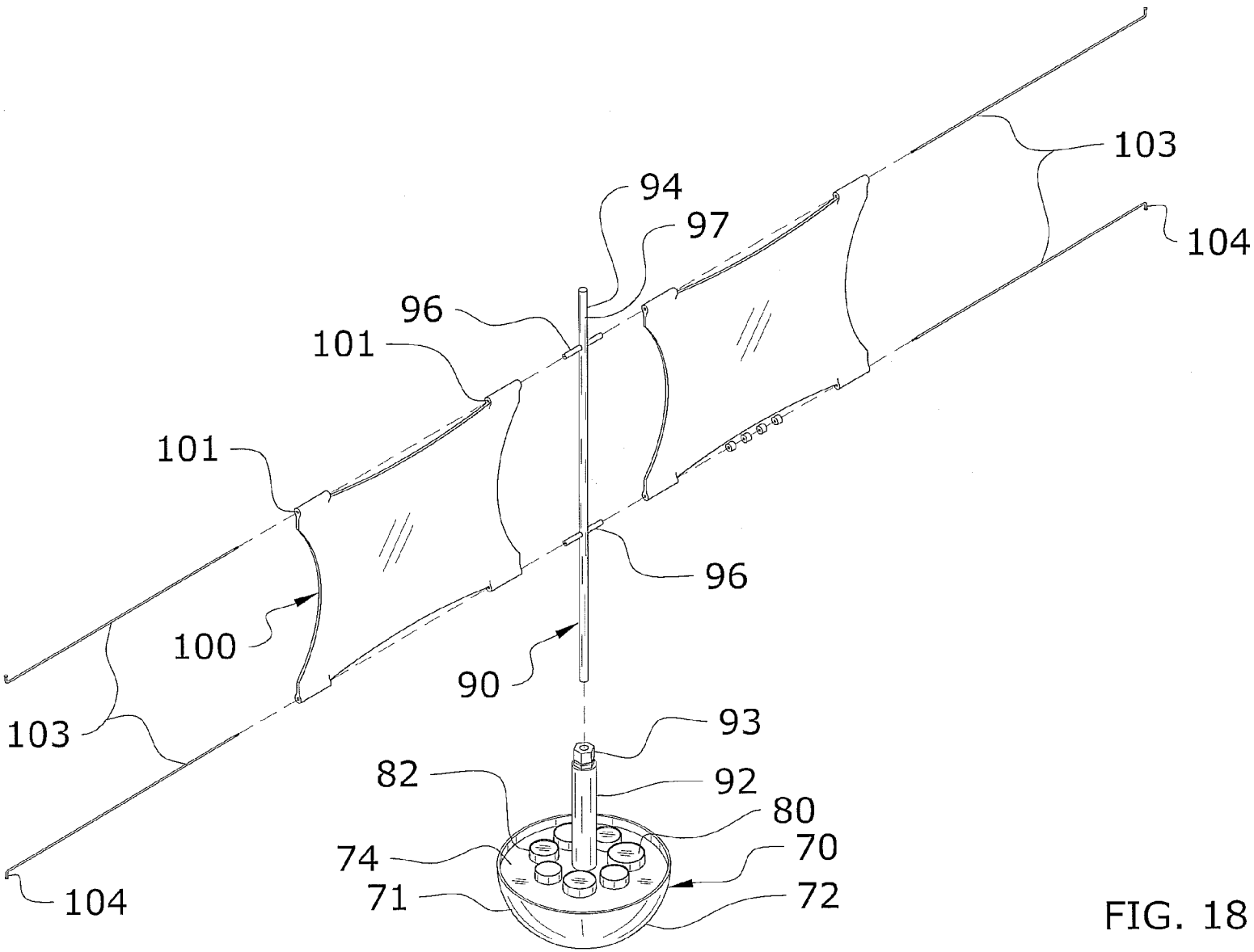
FIG. 18 is an upper perspective view of the apparatus in the first game embodiment with the sails exploded.
Figure 19:
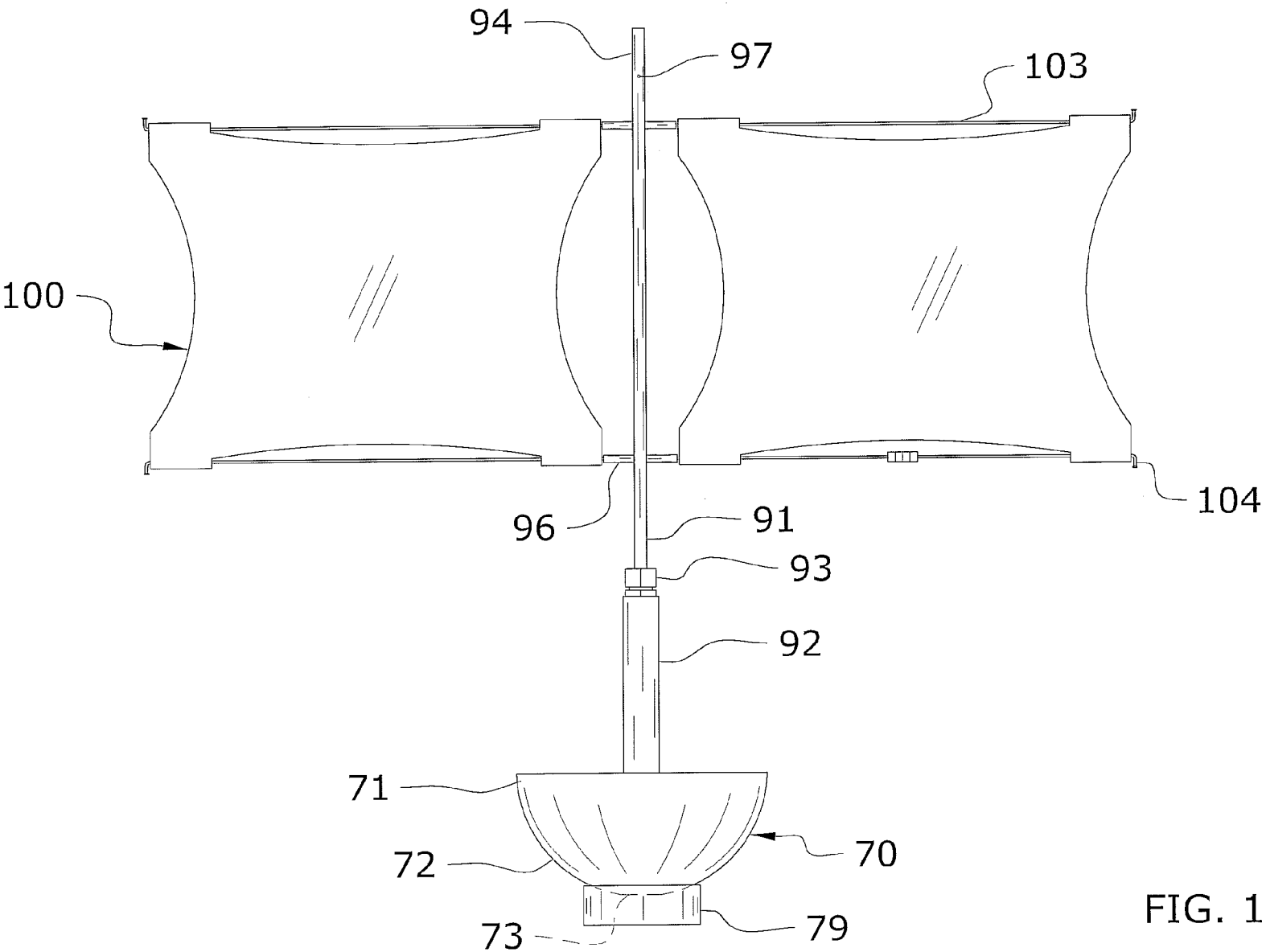
FIG. 19 is a front view of the apparatus in the first game embodiment positioned within the holder.
Figure 20:
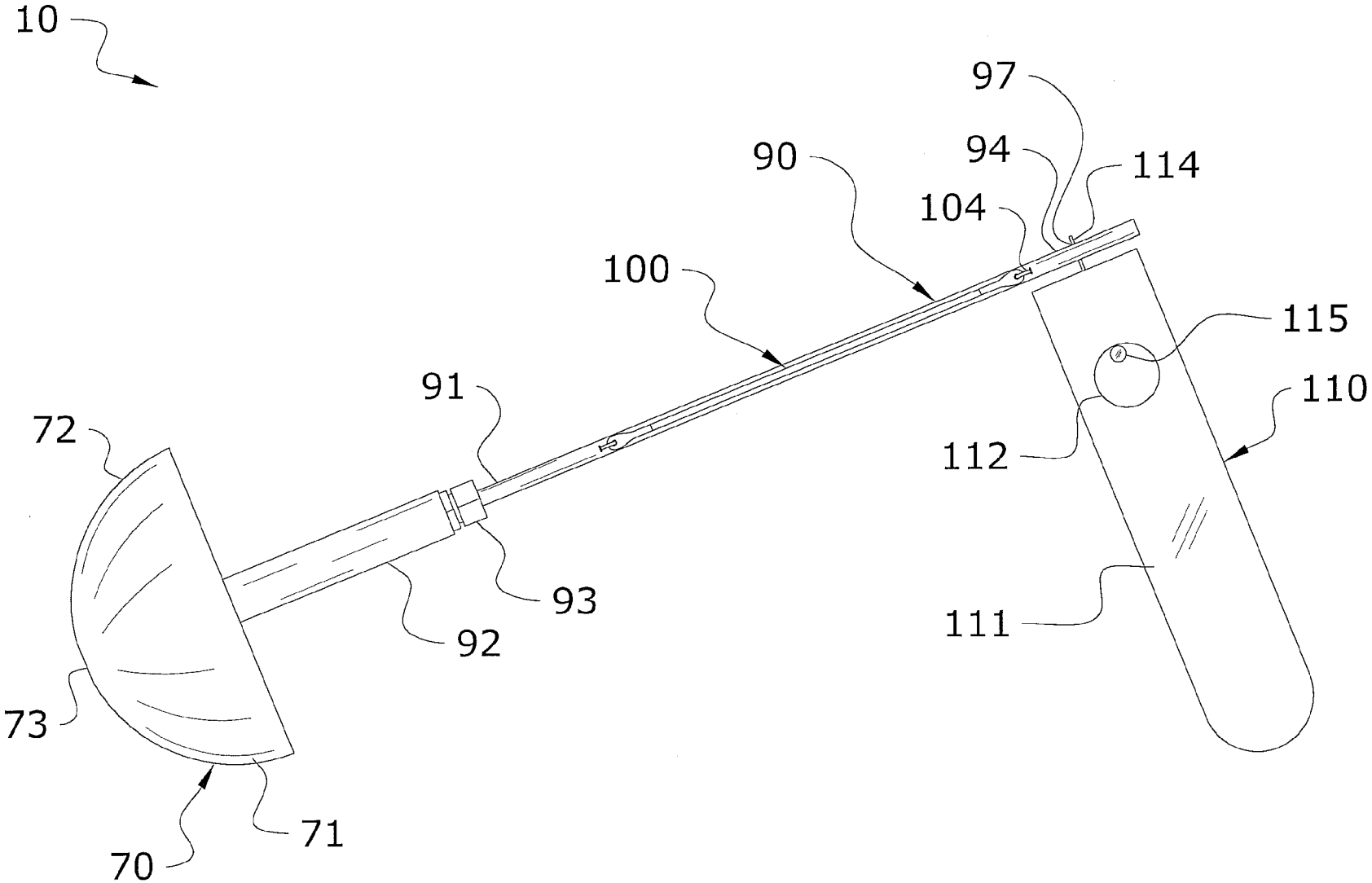
FIG. 20 is a side view of the apparatus in the first game embodiment, wherein the apparatus is in a tilted position and attached to the launcher.
Figure 21:
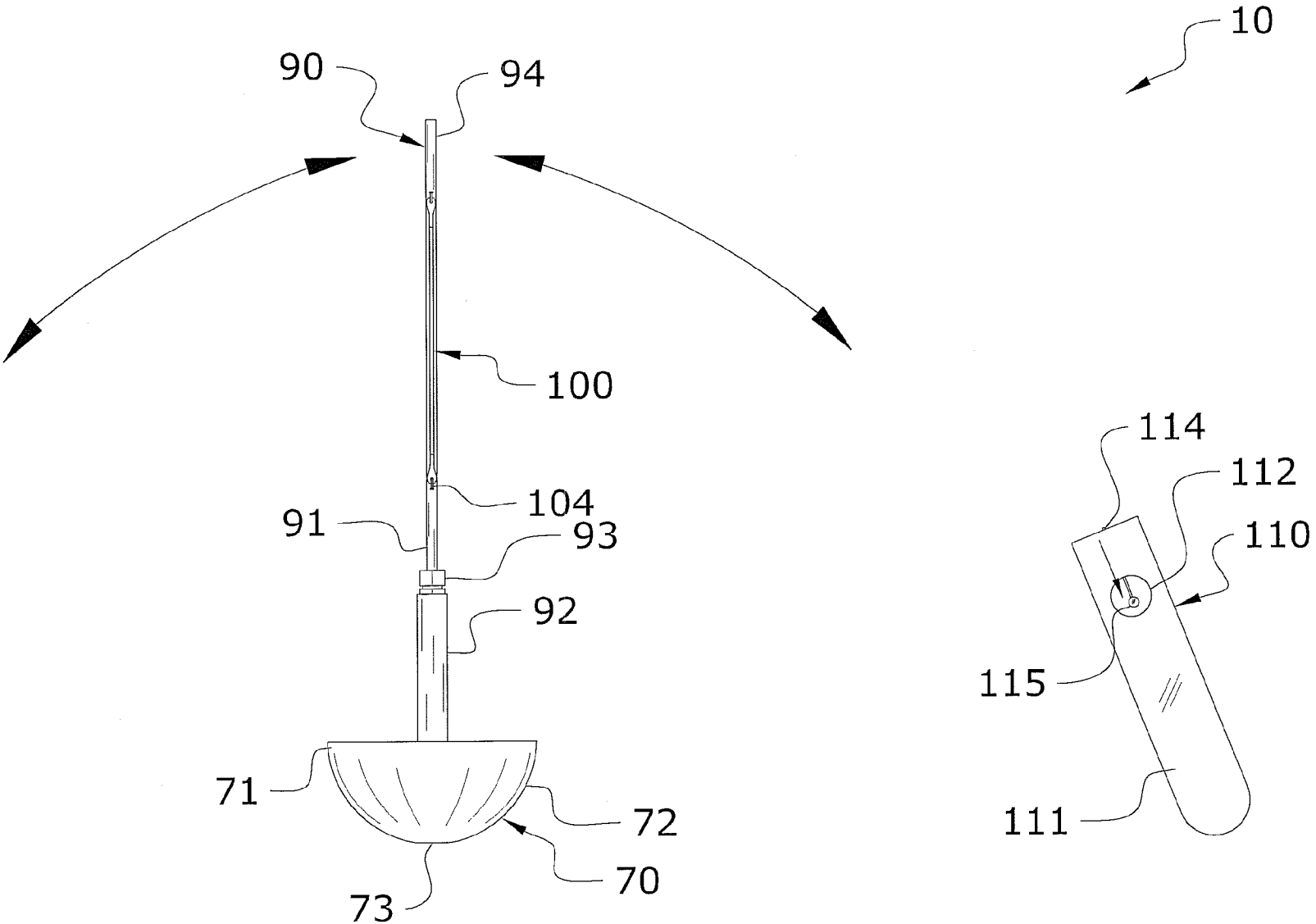
FIG. 21 is a side view of the apparatus in the first game embodiment, wherein the apparatus released from the launcher to start a wobbling process.
Figure 22:
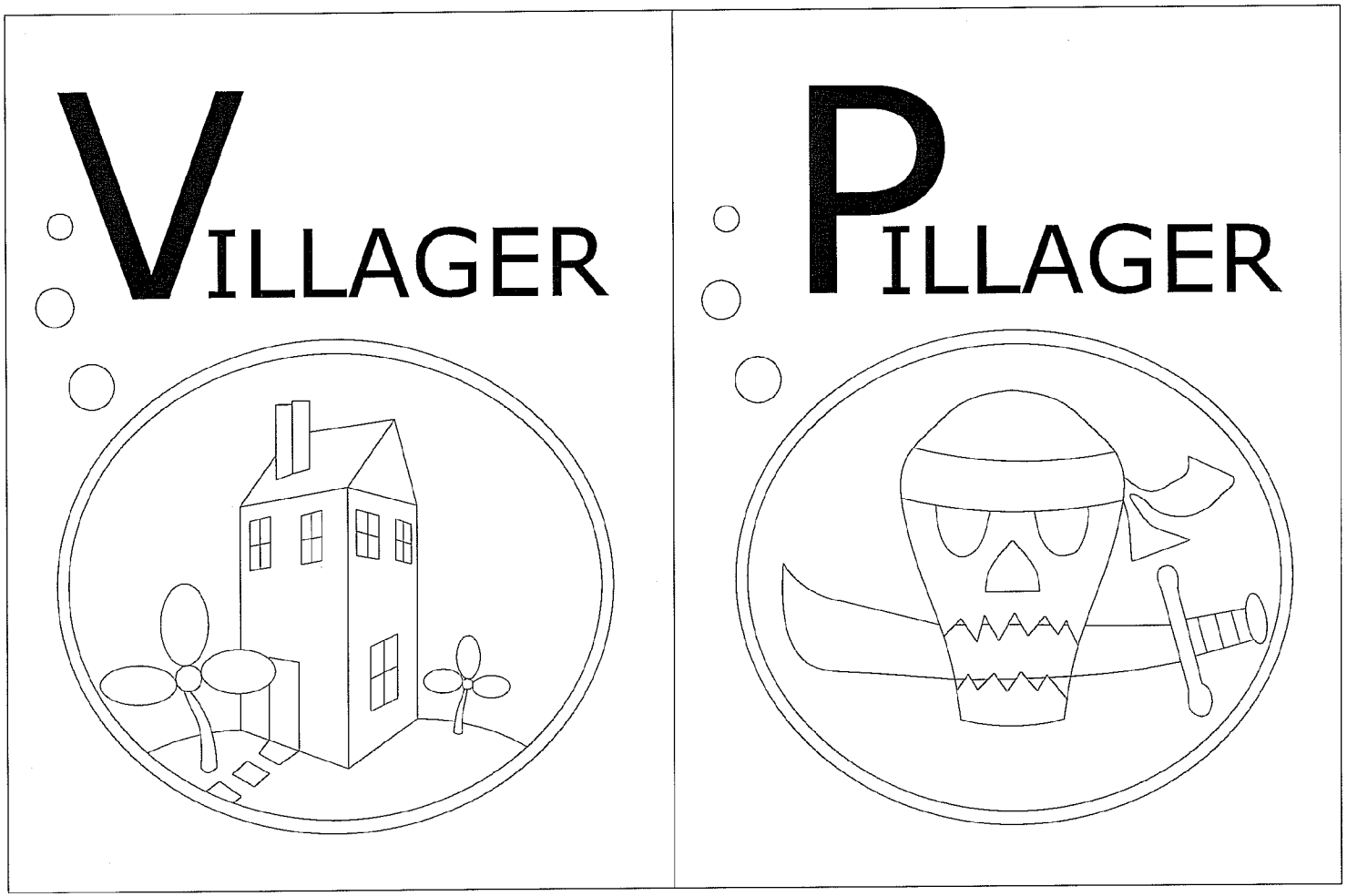
FIG. 22 is a chart illustrating a possible scoring sheet used during the first game.
Figure 23:
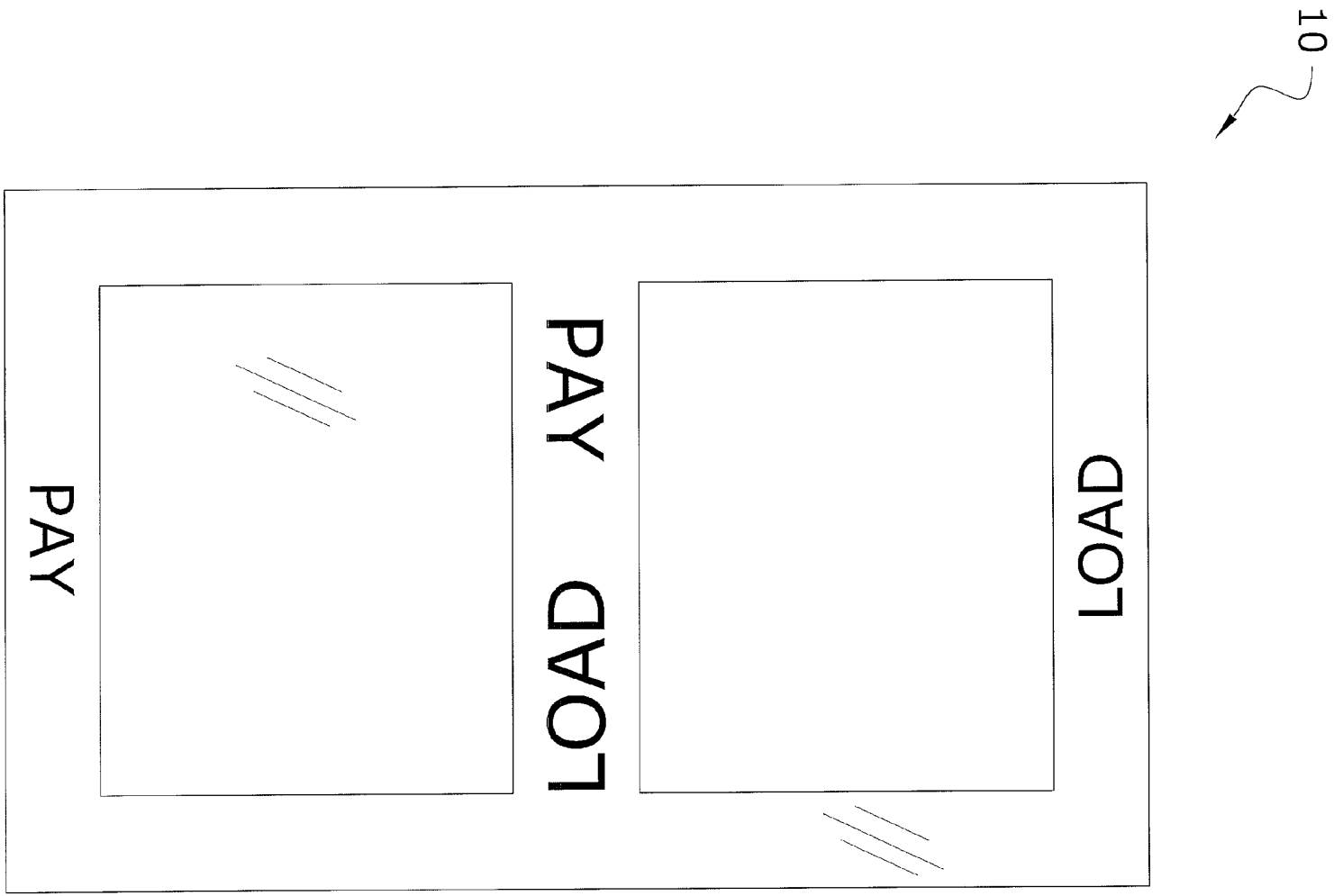
FIG. 23 is an illustration of pay/load designation that may or may not be placed in the base.
Figure 24:
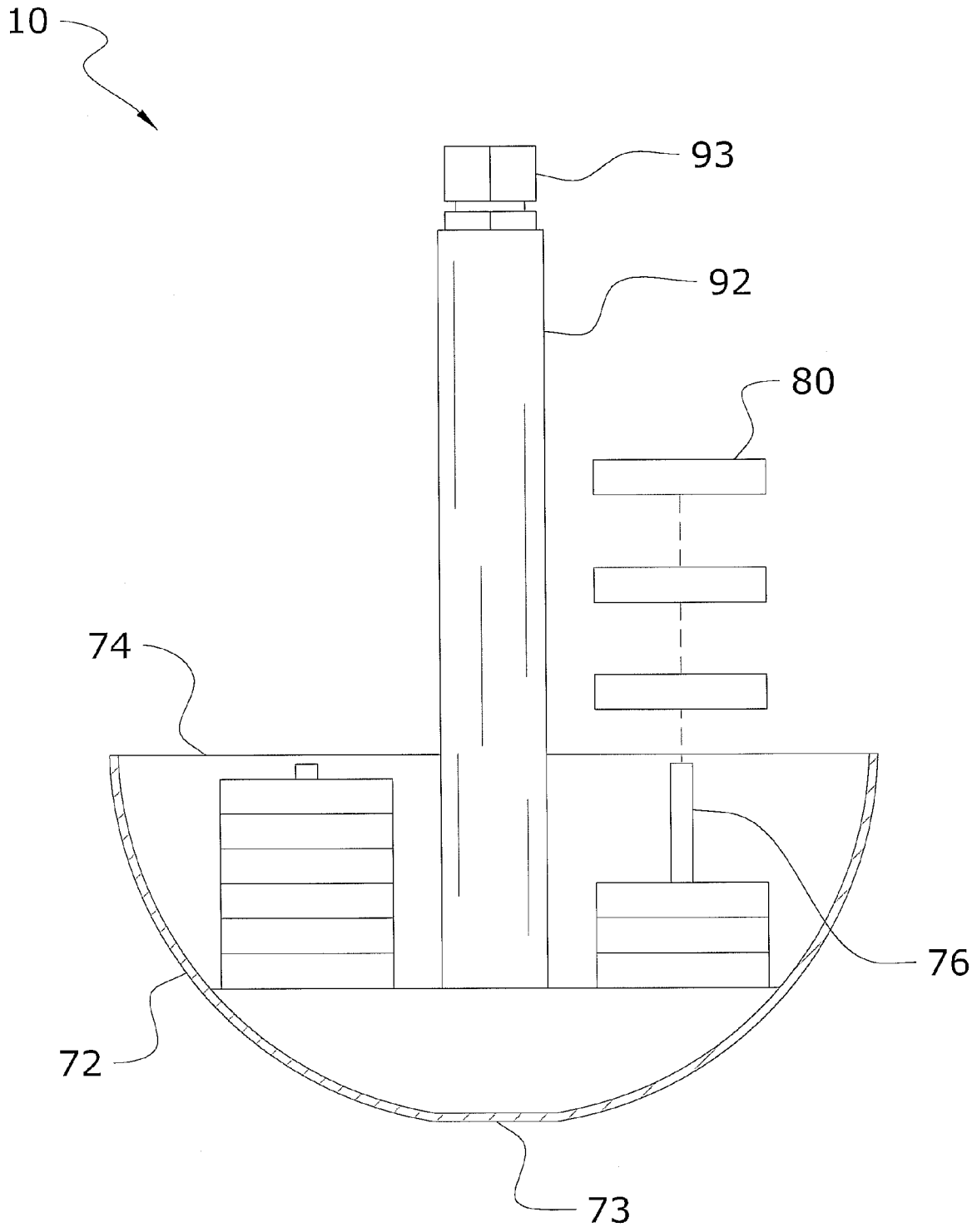
FIG. 24 is a side sectional view illustrating the weighted objects being placed in the base.
Figure 25:
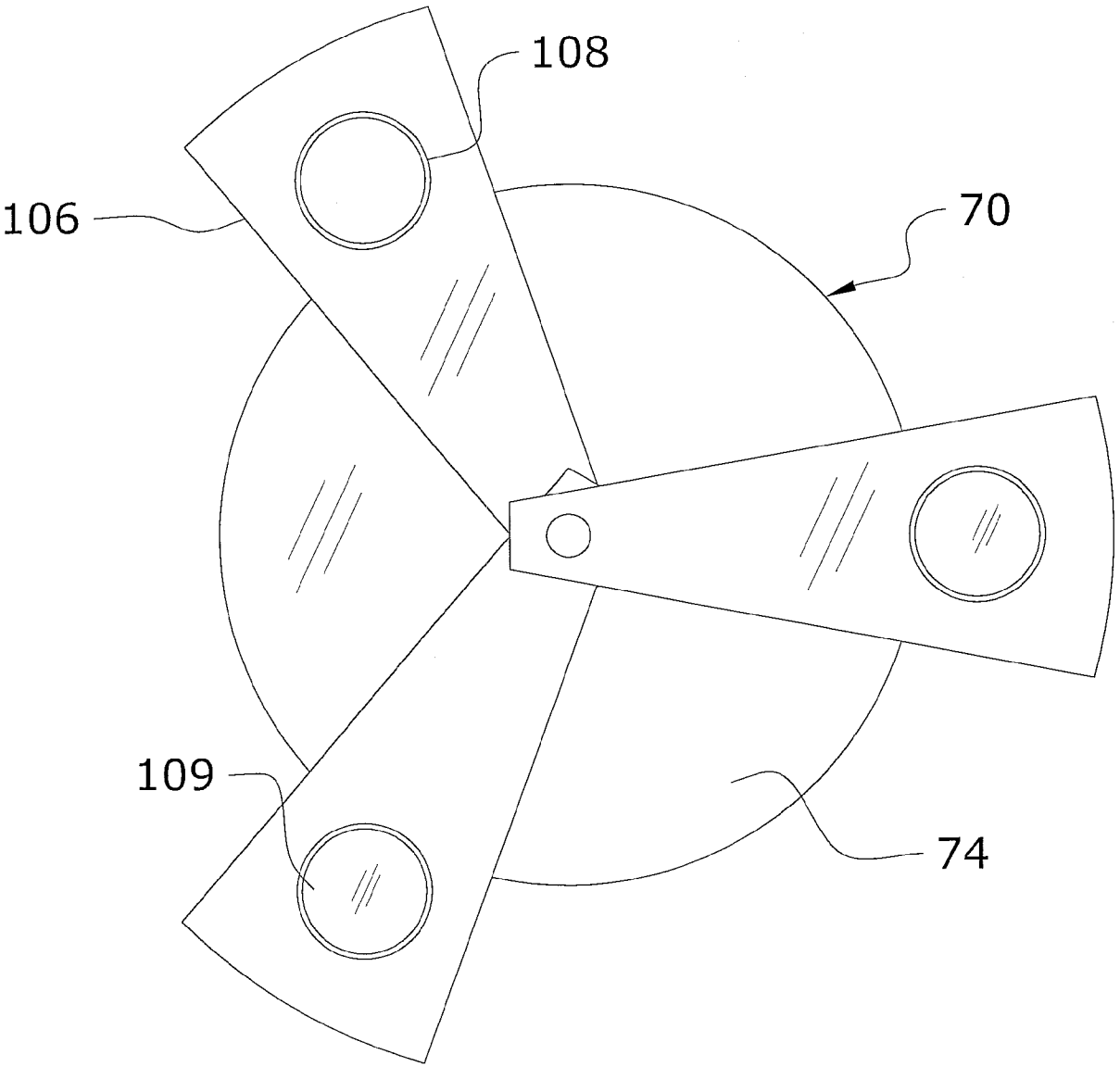
FIG. 25 is a top view of a second game embodiment of the apparatus.
Figure 26:
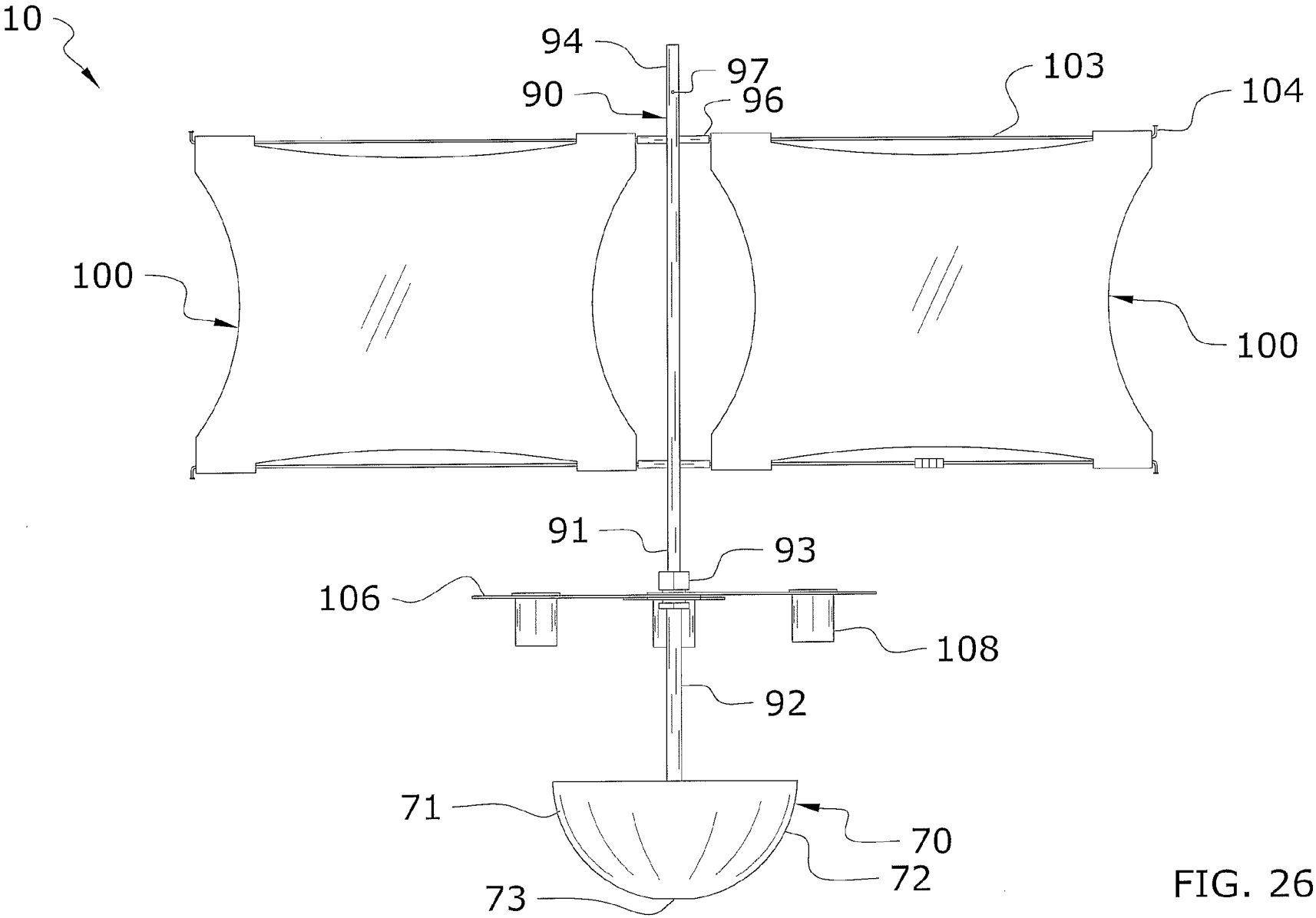
FIG. 26 is a front view of the second game embodiment of the apparatus.
Figure 27:
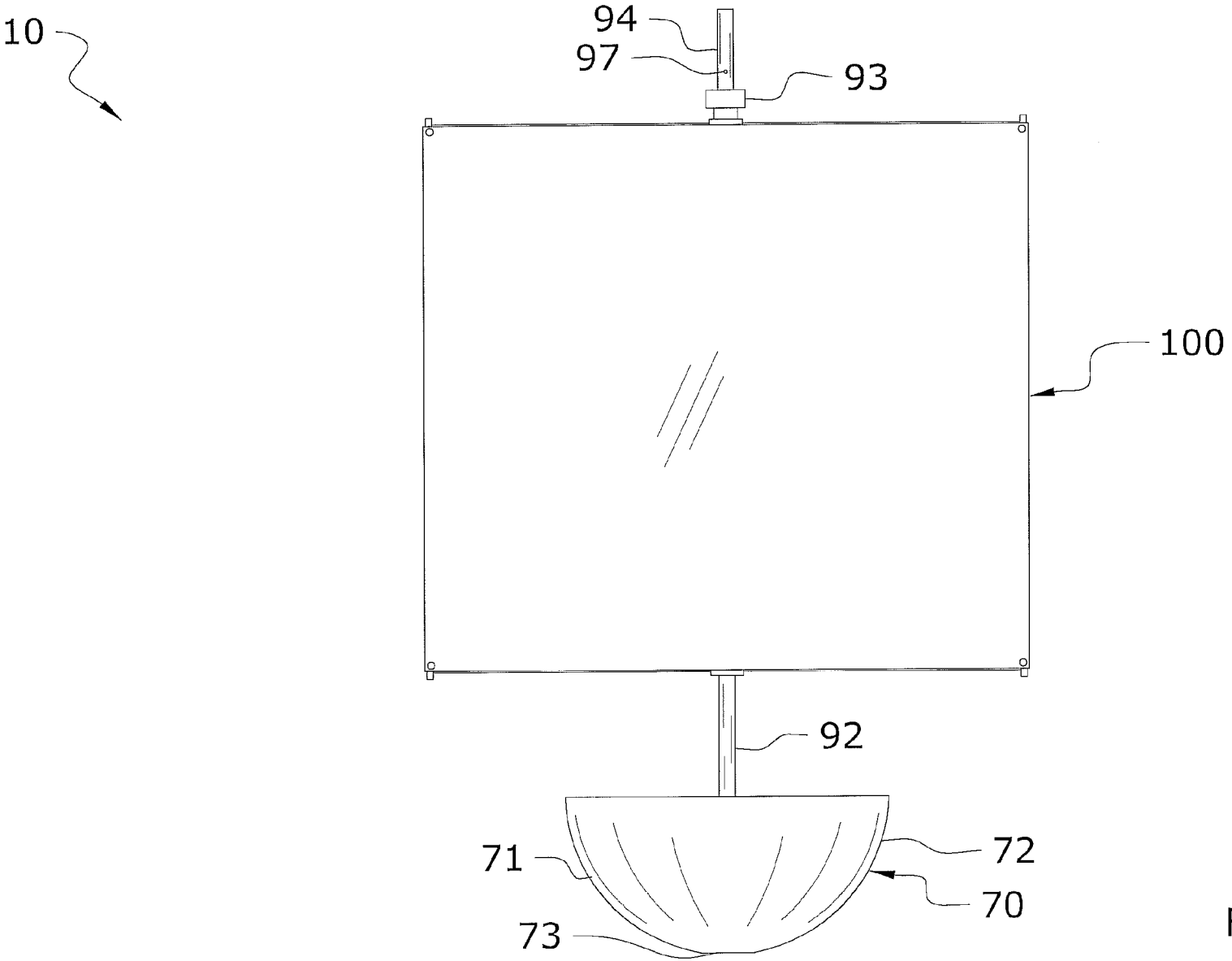
FIG. 27 is a front view of a third game embodiment of the apparatus.
Figure 28:
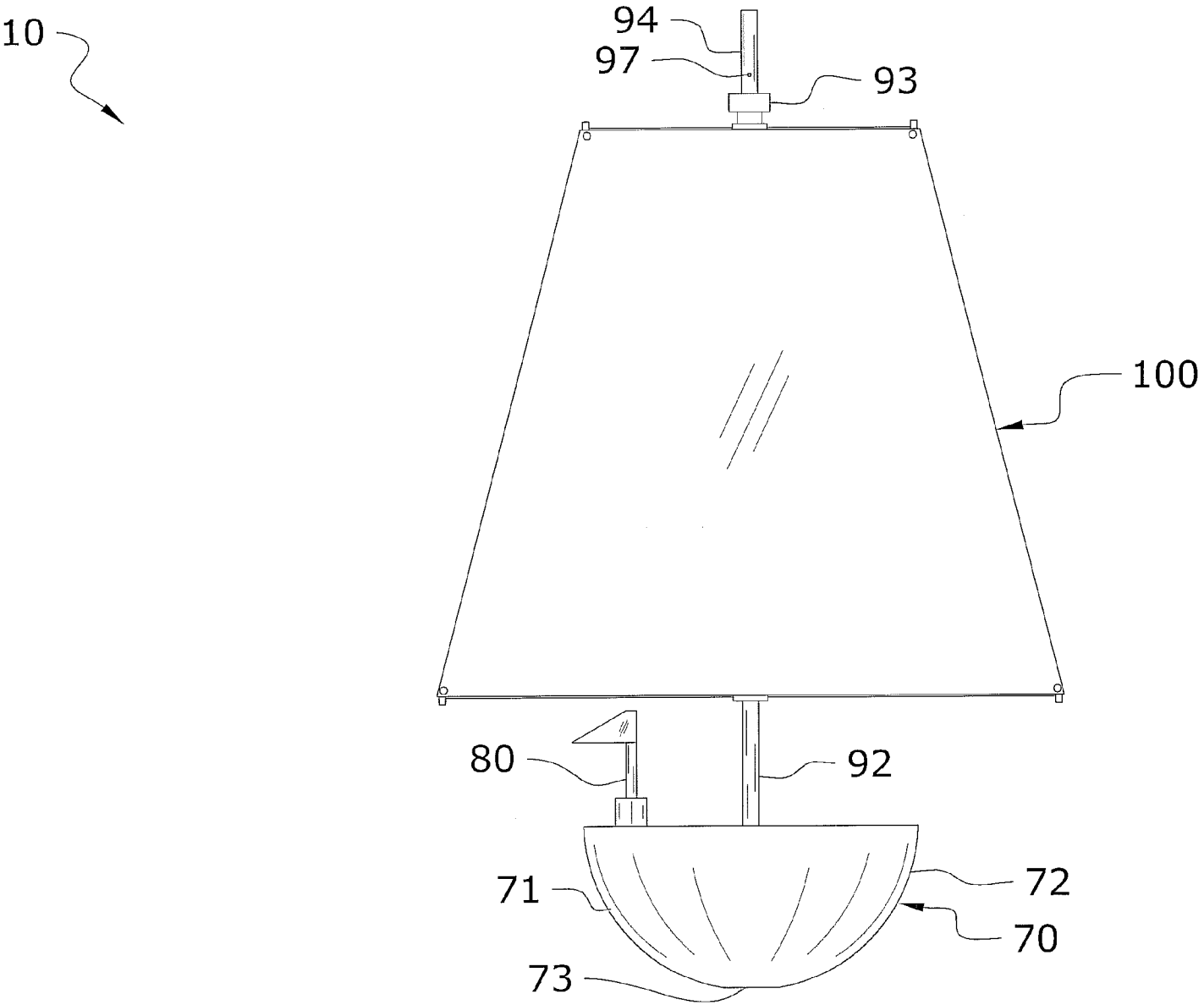
FIG. 28 is a front view of the third game embodiment of the apparatus including a magnetized weighted object.
Figure 29:
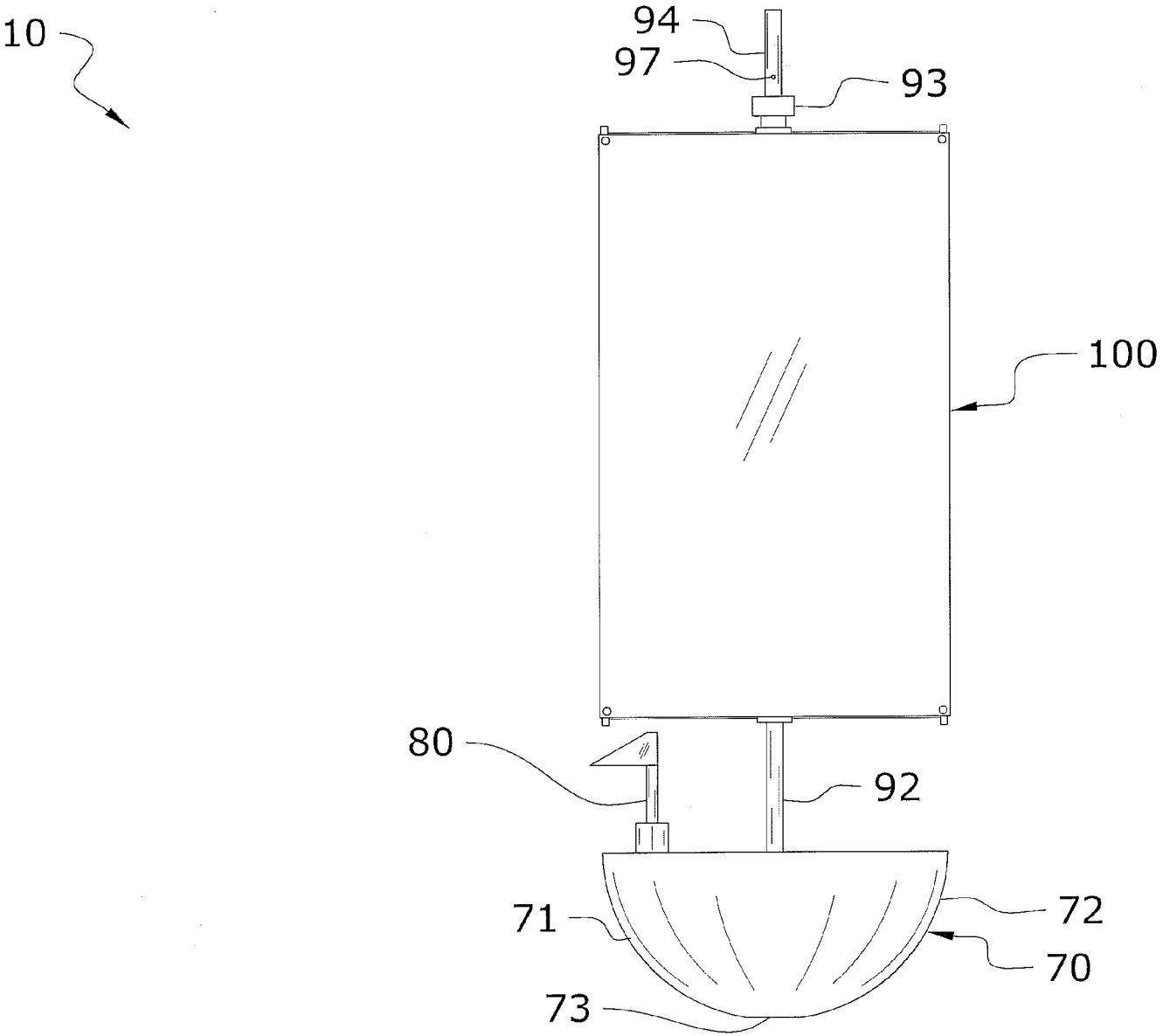
FIG. 29 is a front view of an alternate third game embodiment of the apparatus including the magnetized weighted object.
Figure 30:
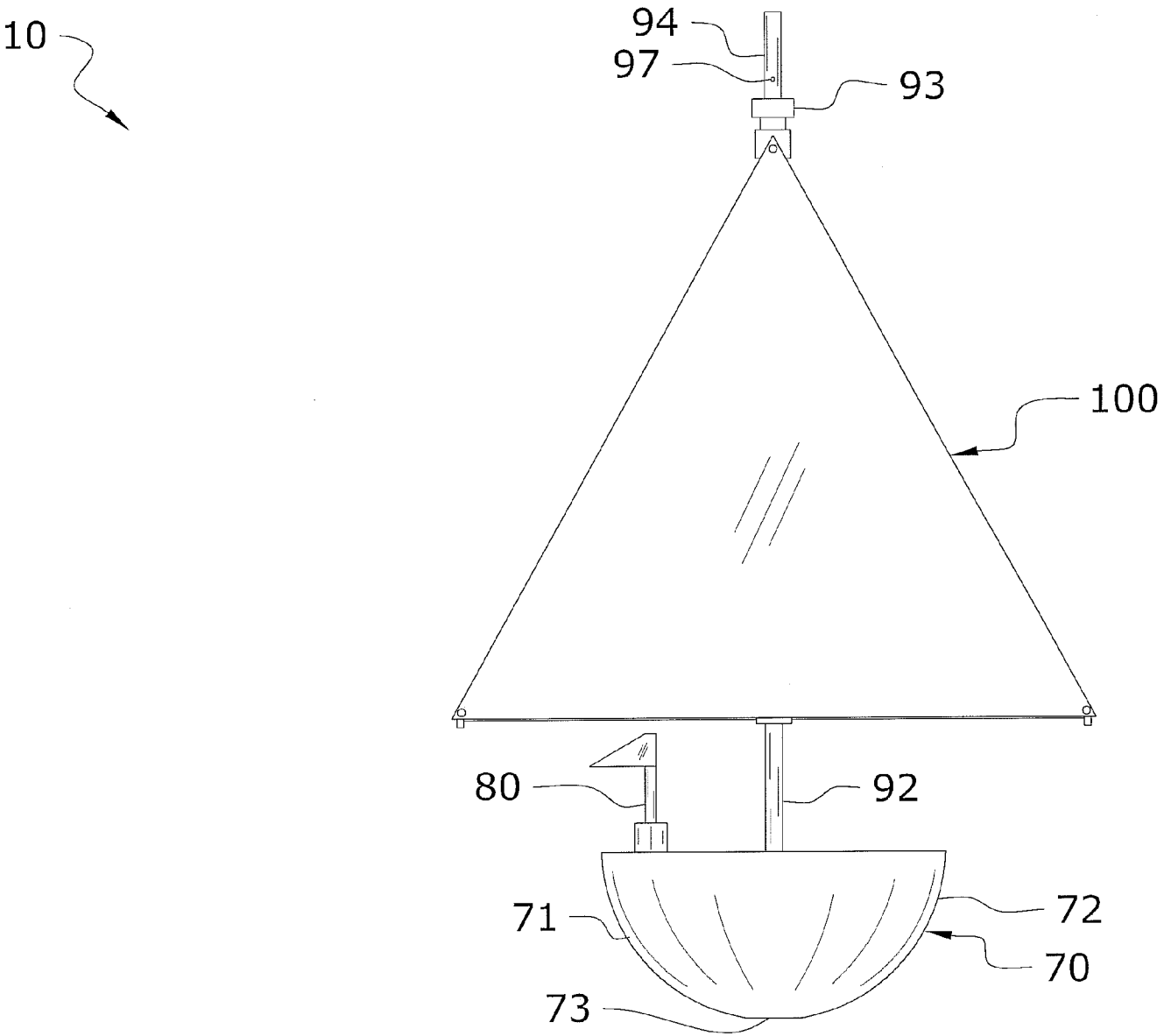
FIG. 30 is a front view of yet another alternate third game embodiment of the apparatus including the magnetized weighted object.
Figure 31:
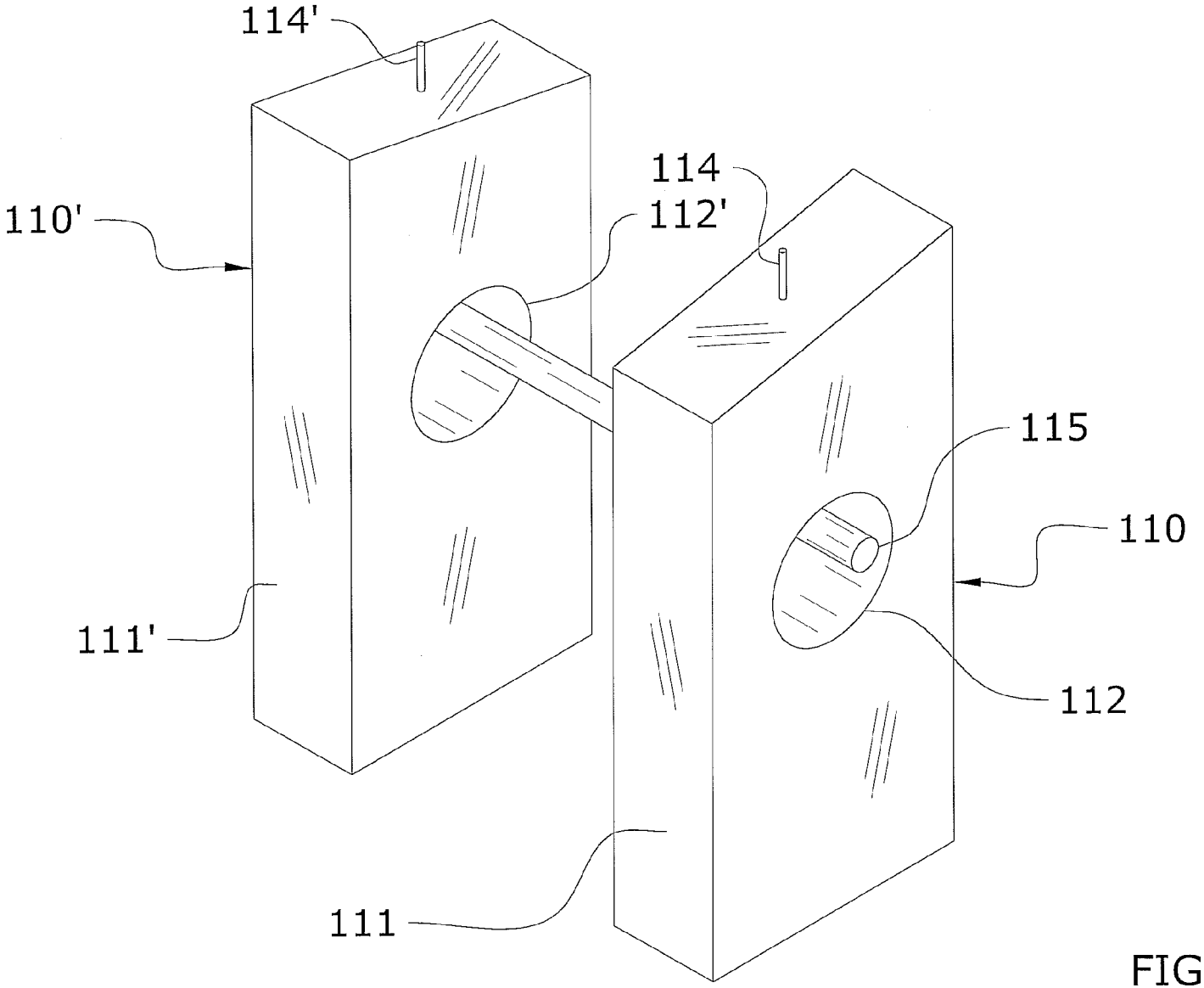
FIG. 31 is an upper perspective view of a tandem launcher.
Figure 32:
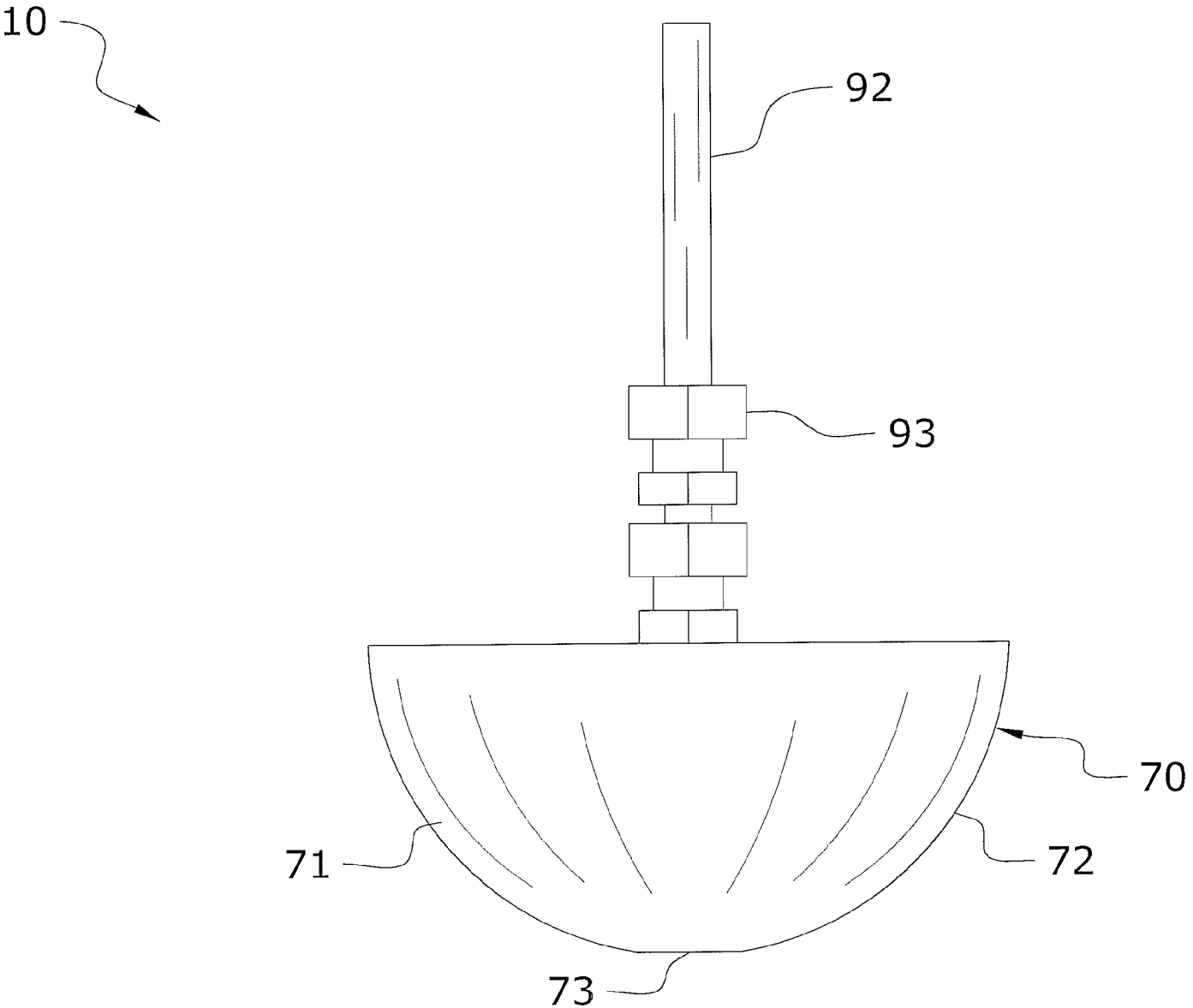
FIG. 32 is a side view of the fourth game embodiment of the apparatus with the clamp in the lowest position.
Figure 33:
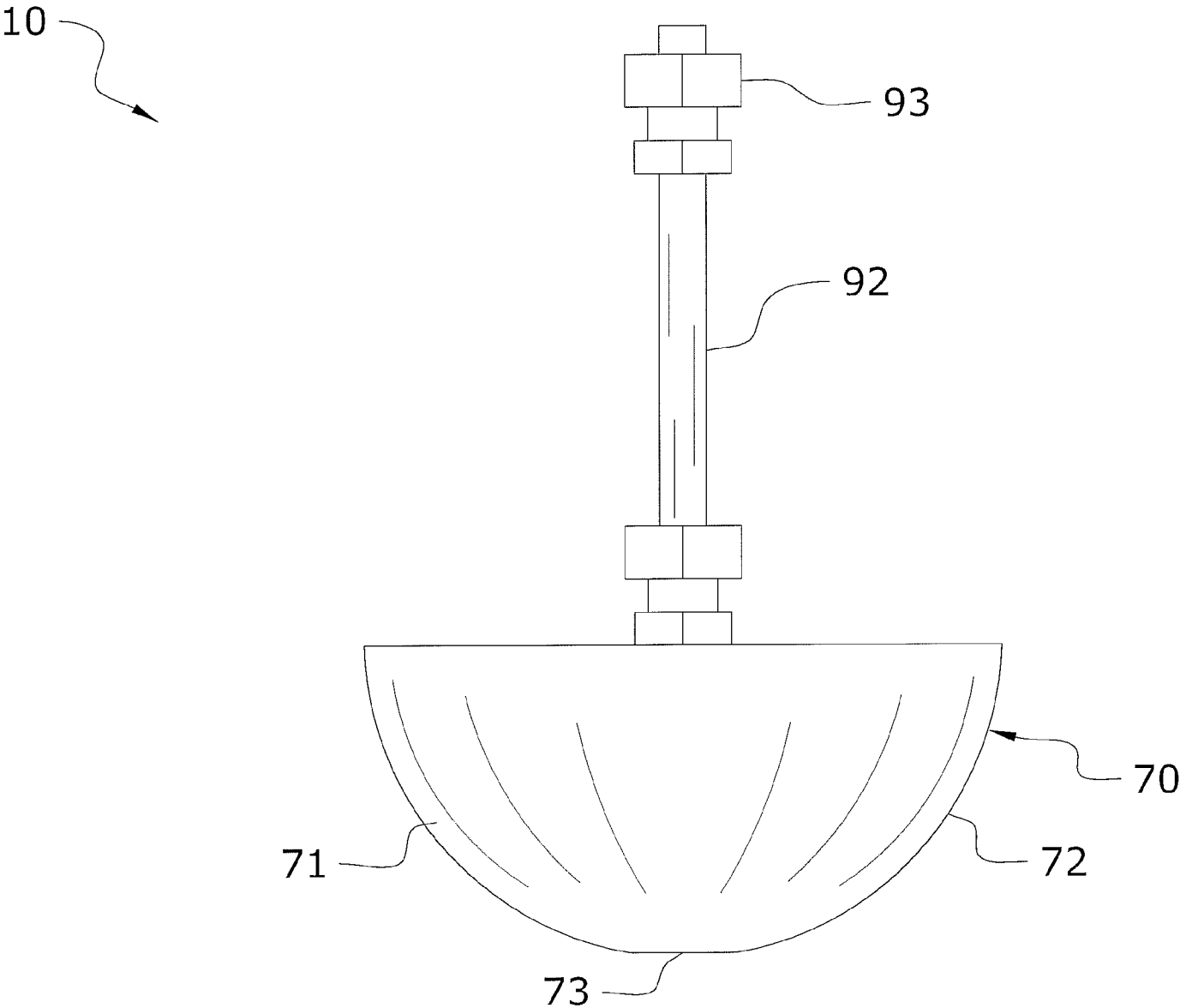
FIG. 33 is a side view of the fourth game embodiment of the apparatus with the clamp in the highest position.
Figure 34:
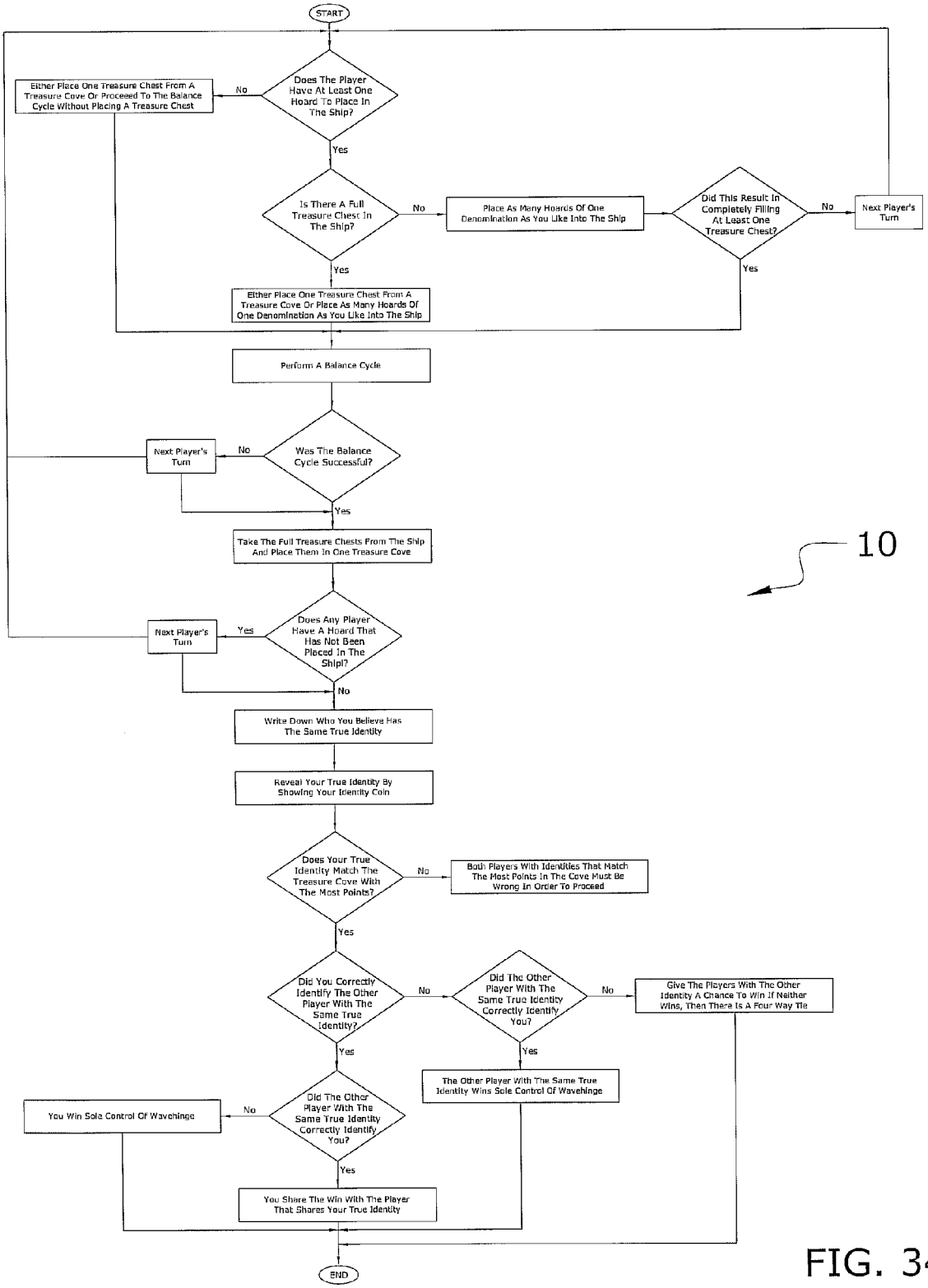
FIG. 34 is an illustrative game play of the first game using the first game embodiment of the apparatus.

In another alternate embodiment, the present invention may be comprised of a sailboat as illustrated in FIGS. 14 and 15. The sailboat embodiment is also described in more detail subsequently in the Game Embodiment portion of the present invention. The sailboat may serve as a decorative bank or other container 19. The sailboat includes a hull which functions as the upper section 20 and lower section 40 and includes a lower internal cavity 43 within for holding the ballast 14 (the upper section 20 may be removable or non removable from the lower section 40). The ballast 14 in this embodiment is comprised of coins, wherein the hull may include a slot or other insertion area in which to add coins to the lower internal cavity 43 as desired. The curvature of the lower section 40 does not need to be the same for the entirety of the lower section 40. The user is forced to maintain a balance of the sailboat embodiment via the counterbalance mechanism 50.

The sailboat also includes a center mast to function as the center post 51 of the counterbalance mechanism 50. A plurality of individually rotatable sails extend outwards from the center post 51 to function as the wing members 55 and are rotatably attached to the center post 51. As the user adds coins to the lower internal cavity 43, the user needs to adjust the position of the sails with respect to the center post 51 to maintain the present invention in an upright position. The sails (i.e. wing members 55) may be comprised of individual different sizes and weights to allow for increased complexity and entertainment in keeping the hull stabilized. The sails may also initiate the wobbling motion of the container 19 (i.e. hull) via catching wind.

II. Game Embodiment

A. Overview

It is appreciated that various aspects of the game embodiment may be combined with the display embodiment of the present invention and vice versa. The game embodiment is used to determine an outcome of a game, wherein the outcome may be an intermediate step in the game, a final winning step, a beginning step or any outcome, large or small, relating to a game.

Turning now descriptively to the drawings, in which similar reference characters denote similar elements throughout the several views, FIGS. 16 through 34 illustrate a wobbling game system 10, which comprises an apparatus 70 for determining an outcome of a game, comprising a base 71 including a curved portion 72 and a flat portion 73, wherein the flat portion 73 is positioned at a lowermost end of the base 71 and wherein the curved portion 72 extends from the flat portion 73. At least one ballast 80 is positioned proximate the base 71 or adding weight to the base 71 and an adjustable counterbalance mechanism 90 extends from the base 71 for stabilizing the base 71 on the flat portion 73. A plurality of games, to use the apparatus 70, are also described herein.

B. Wobbling Apparatus

The wobbling apparatus 70 is the essential piece of the present invention which uses the ballast 80 and counterbalance mechanisms 90 to create a wobbling effect when tipped slightly to the side and if the ballast 80 and counterbalance mechanisms 90 are set correctly efficiently uprights the apparatus 70 in a stable position. Wobbling may be defined as pivoting, shaking, rotating or any movement about a common base 71. The apparatus 70 may be formed in various shapes, sizes and from many different types of materials.

i. Base

The apparatus 70 includes a base 71 that primarily provides for the wobbling action of the apparatus 70. The base 71 includes a curved portion 72 extending predominantly along the lower side of the base 71 and a flat portion 73 at the lower end of the base 71. The curved portion 72 can be comprised of a plurality of different curvatures, such as but not limited to hemispherical, so as to provide for a wobbling motion of the apparatus 70. The flat portion 73 provides for a point for the base 71 to gain stability, wherein when the base 71 is centered on the flat portion 73, the base 71 and apparatus 70 stand upright in a stable manner.

ii. Ballast

At least one ballast 80, which may be comprised of a plurality of coins, objects, etc., is preferably positioned within the cavity of the base 71 or atop the base 71, and the position, alone, or in combination with the counterbalance mechanism 90, may serve to balance the apparatus 70. Many other weighted objects may be used, such as metal rods, metal pipes, sand, water filled containers, stones, or marbles. The ballast 80 may be manufactured within the base 71 or placed in the base 71 by the players of the game. It is appreciated that the placement of the base 71 is a source of variability in the wobbling game design.

The base 71 may include various ballast 80 receivers, such as holes 75 or poles 76 to secure the ballast 80 within or upon thereof. For example, holes 75 within the base 71 may be removably filled with a number of ballast 80 choices. Various retrieval devices (e.g. magnets) may be used to assist in retrieving the ballast 80 from the holes 75. Another example may include the use of poles 76 to secure the ballast 80, wherein the ballast 80, comprised of segmented pipes, rings, etc., would be secured in location via the poles 76. It is appreciated that the ballast 80 may include any weighted object attached to, positioned upon or integral with the base 71. The plurality of ballasts 80 (e.g. weights such as coins, etc.) may further be positioned within retainer cups 82 which may be placed within the holes 75 of the base 71 or on the top surface 74 of the base 71.

iii. Counterbalance Mechanism

A counterbalance mechanism 90 is generally included with the apparatus 70 and is positioned above the base 71 and ballast 80. It is appreciated that in some configurations, the counterbalance mechanism 90 may be placed within the base 71. The counterbalance mechanism 90 may further be separated from the base 71 via being connected to the vertical extension 91. The counterbalance mechanism 90 offers another source of design variability for balancing the apparatus 70. The counterbalance mechanism 90 may allow for a proper horizontal center of mass, but if the vertical center of mass is too high the apparatus 70 will not balance. The vertical center of mass may be lowered by lowering the counterbalance mechanism 90. The counterbalance mechanism 90 is any component or element that offsets the weight of the ballast 80 or base 71 so as to be manipulated or adjusted to affect the wobbling motion of the apparatus 70 and manner and time in which the apparatus 70 may become stabilized after wobbling. It is appreciated that the apparatus 70 may include a plurality of counterbalance mechanisms connected to or separate from one another, all which control a movement and balance of the base 71.

The counterbalance mechanism 90 may be comprised of a multitude of designs, such as weighted beams which may be twisted to one side, sliding weights upon the vertical extension 91 positioned to act to counter the ballast 80 within the base 71, or adjustable countering weights 109 located on top of the base 71. The counterbalance mechanism 90 may further be altered (i.e. change the degree in which countered weight is placed on the base 71) via twisting or rotating the counterbalance mechanism 90 about the base 71. Other configurations include a magnetized countering weight 109 that may be placed at various locations atop the base 71.

The counterbalance mechanism 90 may include the vertical extension 91 that preferably extends upward from the base 71. The vertical extension 91 is preferably fixed to the base 71 and is adjustable in height to adjust the manner in which the apparatus 70 is able to balance. In the preferred embodiment, the vertical extension 91 includes a lower segment 92 directly extending upwards from the base 71, and an upper segment 94 telescopingly adjustable from the lower segment 92. A threadable clamp 93, generally positioned at the upper end of the lower segment 92, may be used to secure the upper segment 94 in a fixed vertical position by tightening the clamp 93 about the vertical extension 91. The clamp 93 is preferably weighted and may be used in the fourth game embodiment of the apparatus 70 as an adjustment means of a timer, wherein the apparatus 70 is used as a timer.

Various types of sails 100 may also be included in the counterbalance mechanism 90. One such sail 100 extends from the upper end of the vertical extension 91, such as in the first embodiment of the apparatus 70. The sail 100 includes multiple slots 101 that receive connecting elements 103. The connecting elements 103 are comprised of a wire like configuration to extend through the slots 101 of the sails 100 and threadably connect to retaining elements 96 of the vertical extension 91. Magnets 109, functioning as weighted objects, may also be placed on the sail 100, and more particularly onto the connecting element 103, to further provide a dampening or counterbalance force for the apparatus 70. The weighted objects 109 are slidable along the connecting element 103. The connecting elements 103 may further include catch portions 104, which are configured as L-hooks, to catch the sail 100 and secure the end of the sail 100 upon the connecting element 103.

When the object of the game base 71 is to provide a balanced or unbalanced outcome, it can be beneficial to have the outcome in a rather short period of time. The sails 100 offer a way to shorten a balance cycle time (described subsequently) by buffering the fast movement of the base 71, and slowing 106 the speed of the wobble rather quickly. Once the wobble speed slows, the sails 100 allow the slower movement of the base 71 to occur largely unimpeded. The sails 100 could be twisted relative to each other in various embodiments. However, it is preferred that the sails 100 remain in a common plane so as to be more easily operated. Different sail 100 sizes, numbers, shapes, and locations may be appreciated with different embodiments.

In the second embodiment of the apparatus 70, the ballast 80 is in a fixed location and weight can only be added above the base 71 resulting in some destabilization of the apparatus 70. The counterbalance mechanism 90 allows for a proper horizontal center of mass, but if the vertical center of mass is too high the apparatus 70 will not be balanced. The wings 106 in the second embodiment may thus be lowered towards the base 71 if it is desired to achieve stability. It is appreciated that the wings 106 may include retainer cups 108 for the weighted objects 109 and are adjustable in height and rotation as well as being able to hold differing amounts of weighted objects 109.

In the third embodiment, the vertical center of mass changes with the horizontal center of mass in the form of a tilted countering weight 109. Counterbalance is achieved through a magnetized weighted object 109 placed upon the top surface 74 of the base 71. The weighted object 109 may be various configurations, such as a flag pole, etc. and placed at various locations upon the top surface 74 of the base 71. The sail 100 in the third embodiment is preferably adjustable in position.

The fourth embodiment is used as a timepiece. When adjusting the length of wobble time of the apparatus 70 in the fourth embodiment, positioning the clamp 93 at the lowest position shortens the wobble time and positioning the clamp 93 at the highest position lengthens the wobble time. The clamp 93 and attached vertical extension 91 in this embodiment serve as the counterbalance mechanism 90.

C. Launcher

The present invention includes a launcher 110 to wobble the apparatus 70. The launcher 110 is a mechanism that is removably secured within the upper opening 97 of the vertical extension 91. The launcher 110 includes a handle 111, a connecting rod 114 and a trigger 115 which is accessible through a finger opening 112. The connecting rod 114 is inserted and removably secured within the opening of the apparatus 70 and the apparatus 70 is tiled to approximately 70 degrees it's vertical. The trigger 115 or switch is then pulled, thus releasing the connecting rod 114 from the opening 97 of the apparatus 70 and allowing the apparatus 70 to pivot or wobble away from the launcher 110. The launcher 110 may also be comprised of a tandem launcher 110' including two handles 111', two connecting rods 114', and an elongated trigger 115' extending through multiple openings 112' to simultaneously engage both connecting rods 114'.

D. Game Methods

Various game play methods may be utilized with the apparatus 70. Generally game play involves balancing the apparatus 70 utilizing the ballast 80 and counterbalance mechanism 90 both of which may be positioned differently according to the specific game play. It is appreciated that for each described game play, various embodiments may be used and methods in which to play the particular game.

The games preferably include a balance cycle to be used with the apparatus 70. A balance cycle involves loosening the brass circular clamp 93 and rotating the sails 100 to a position that allows the sliding weight to counterbalance the ballast 80. The circular clamp 93 is generally tightened by hand only once the sails 100 are in the desired location. Rotating the sails 100 and sliding the weight 109 must take place while the base 71 is in the holder 79 so a player does not gain any balance knowledge or advantage over other players. After the base 71 is prepared it must be lifted from the holder 79 and placed on a flat, smooth playing surface.

Next, the base 71 must go through the launch process to complete the balance cycle. The launch process involves tipping the base 71 to allow the launcher's 110 extended metal rod 114 to be placed through the small opening 97 in the top of the vertical extension 91. Finally, the rod 114 of the launcher 110 is depressed, releasing the apparatus 70. The base 71 will now wobble, thus go through a balance cycle, and the result will determine the outcome of a step in the chosen game (i.e. whether the apparatus 70 becomes stabilized or topples). Thus, if the balance cycle is successful the base 71 will ultimately settle on the small flat portion 73 on the bottom of the base 71. The apparatus 70 must not be touched or affected in any way until the balance cycle is obviously successful or unsuccessful.

i. First Game

First Game Embodiment

The first game is designed to illustrate a treasure chest scenario. The first game preferably utilizes the first embodiment of the apparatus 70 and can accommodate up to four players. The first game resembles a scenario where the shipwrecked sailors have a goal of collecting treasure and repairing ships. The apparatus 70 is configured as a ship and the ballast 80 is represented by weighted objects (e.g. coins). In the preferred embodiment, a total of ten dollars in coins is used as the ballast 80 with a specific number of quarters, dimes, nickels, and pennies used. It is appreciated that whatever type of weighted objects 80 are used, they are preferably countable, identifiable, and at least partially distinguishable.

A coin stack is represented by 5 of the same coins. The coins 80 are placed in the retainer cup 82 of the base 71 selectively. Each player receives the following 106 seven stacks: 3 penny stacks, 2 nickel stacks, 1 dime stack, and 1 quarter stack. Place any stacks not distributed at the beginning of the game in the proper size retainer cup 82 in the base 71. Each of the seven retainer cups 82 represents a treasure chest. The retainer cups 82 may also be different sizes to accommodate different size objects. The point value of each filled retainer cup 82 is as follows: dime=1, penny=2, nickel=3, and quarter=4. A total of 17 points are possible. The total point value of stacks of coins 80 in the retainer cups 82 at the end of the game will help determine the winner(s) of the game. It is appreciated that in this embodiment, the retainer cups 82 may be placed upon the top surface 74 of the base 71 by the user. The retainer cups 82 may also be placed in specifically sized holes 75 in the base 71.

The vertical extension 91 is extended to a specific point, which may be represented by a mark and the apparatus 70 is placed in the holder 79 with all seven retainer cups 82 aboard. Laminated cards are placed on the playing surface and identification elements (e.g. 2 villager and 2 pillager coins) are placed in a pouch and shook up. During game play, players take turns pulling an identification element from the pouch. The player's identification element and true identity must be kept secret throughout the game, but players may allude to an identity or try to deceive other players for personal gain.

Players roll a die to determine who goes first. During general game play, each turn involves placing at least one stack in the base 71. A player may place any number of the same denomination stack. For example, a player may place one, two, or all three penny stacks on a single turn. The stacks can be placed in one, two, or all three penny retainer cups 82. A stack placed in a retainer cups 82 will remain there for the duration of the game. When stack placement results in completely filling one or more of the retainers, the player is allowed to perform a balance cycle. If the balance cycle is unsuccessful the apparatus 70 is placed back in the holder 79, and play moves clockwise.

Players are allowed to perform a balance cycle on each turn in which there is at least one full retainer in the apparatus 70. If a player encounters an apparatus 70 with completely filled retainer cups 82, the player must either: (1) add a stack(s) to another retainer(s), and then perform a balance cycle, or (2) add a filled retainer from one of the designated areas that correspond with any of the identification elements, and then perform a balance cycle.

A player who balances the apparatus 70 must place all of the completely filled retainer cups 82 in a designated area (which may or may not match the designated area corresponding to their identity determined by the identification element) off of the apparatus 70. The partially filled retainer cups 82 remain in the apparatus 70. The designated area a player chooses does not have to match the player's true identity. The player must only place retainer cups 82 in a designated area per balanced apparatus 70. Once the retainer cups 82 are placed in a designated area, the apparatus 70 is reset in the holder 79 with the vertical extension 91 set at the designated point and play moves clockwise.

The endgame starts when a player has no stacks to load. During the endgame players with no stacks must either: (1) perform a balance cycle, or (2) load one retainer cup 82 from a designated area onto the apparatus 70 and perform a balance cycle on their turn. The last apparatus 70 is denoted by loading the final stack aboard the apparatus 70. After the last apparatus 70 has been balanced and the final retainer cups 82 full of coins are dispersed, all players must declare on paper and conceal who they believe to be the one other player with the same true identity. The written declaration of identity will remain secret until all players are prepared to reveal their identification elements and written declarations.

The identity with the most points in the designated area is allowed the first opportunity to win by revealing the written declarations. If both players correctly identify the other, then they share the win. If only one is correct, then the single correct player is the sole winner. If neither is correct, then the players with the fewest points in their treasure cove are allowed a chance to win. If both correctly identify the other, then they share the win. If only one is correct, then that player is the sole winner. If neither is correct, then there is a four way tie and all players share the win. In games with two or three players, the players must declare in writing who the other player is with the same identity, or if there was no other player with the same identity.

Generally, odds favor players with more objects in the designated area that matches their identity. Players will desire to remain unknown by the other players. Deception and deliberate object placement are at odds in the game. Players can play one identity and change to the other at the end, or play a deceptive identity to the end and hope it works out. A detailed description of winning probabilities and the myriad of outcomes is not necessary to play strategically. One very helpful strategy of play is to document each player's moves and track tendencies throughout the game. Written accounts of play could be exhaustive, so shorthand codes are used to track play. Each player may use the following 106 approach to learn a shorthand code and perhaps eventually keep track mentally.

Each turn can be graded as to its intent and severity. The intent will be either pillager (P), villager (V). The severity will be based on the point value of the retainers. If a player steals a penny retainer from the villager's designated area, successfully balances the apparatus 70, and places the retainer in the pillager's designated area the intent would be decidedly pillager in nature. We will grade this as P4, using P for the pillager intent and 2 for the number of points stolen from the villager cove added to 2 points given to the pillager cove. If the same player later fills stacks in a nickel retainer, balances the apparatus 70, and places the retainer in the pillager cove we could grade this as P3 and add it to P4 for a total of P7 for that player. Similar intents add together. The same player then balances the last apparatus 70 that contains 13 retainer points and places them in the villager cove (i.e. designated area). This can be scored as V13 and combined with the P7 we get a result of V6. Opposite intents subtract, so we have V13-P7, or 13−7=6. The intent is confusing, but deception is part of the game. We can probably declare this player is a villager (i.e. identity), but all other player's actions must be considered to give a more accurate verdict. Each player can keep a notepad and cover their work, or players may all agree on one player recording the point movement during the game. All players can then refer to the recording for decisions.

ii. Second Game

First Embodiment

The second game also preferably utilizes the first embodiment of the apparatus 70. The second game is generally designed for 2-4 players. The game begins with the same retainer cups 82 as the first game and the vertical extension 91 set to the appropriate designated height. The object of the game is to score as much money or get as many objects as possible and leave the apparatus 70 balanced in the end. For this game, the base 71 preferably includes spots for seven retainer cups 82 which may be filled with coins 80 atop the base or within the base 71.

Players roll the die to determine who goes first. Play then moves clockwise. A player must choose one of two basic operations during a turn. A first option is to roll the die and steal the full coin retainer cup 82 corresponding to the number on the die. If the coin retainer cup 82 corresponding to the number on the die is empty, the player may not take any coins and the turn is over. The second option is to place any number of objects and the object retainer(s) back in the base 71 and perform a balance cycle. The turn is over if the balance cycle is unsuccessful.

The first robber to balance the base 71 is allowed to "keep" all of the coins he stole by applying the amount toward his score. Once scored, the coins go back into the game base 71 for the next round. The other robber(s) receive no score for the round and must replace any stolen coins. The first robber to a specified amount (e.g. ten dollars) wins.

iii. Third Game

First Embodiment

The third game also preferably utilizes the first embodiment of the apparatus 70. The third game is a two player strategy game in which players begin with a plurality of stacks of coins 80, and in the preferred embodiment two stacks of five quarters, two stacks of six dimes, four stacks of five nickels, and six stacks of five pennies. The stacks may not be divided into smaller stacks. The sails 100 are set at the lowest level and will be raised according to the rules.

Players flip a coin to determine who goes first. A player must place at least one or two stacks on each turn. The denominations of the stacks are not required to match. The stack(s) must go in any proper size retainers(s) cups 82 on or in the base 71, and either or both of a player's placements must match the prior player's placement if possible.

The two conditions that make a matching placement impossible are: 1) a player doesn't have the matching coins, or 2) the cup is full. If a player finds it impossible to match one or both placements of the prior player, the player may still place up to two stacks in the game base 71. The following player adheres to the same placement rule. This establishes a follow-the-leader style of game play in which the leader can change because a player may decide at any time to place only one stack, even if the prior player has placed two. The single stack must abide by the placement rule.

When placement results in completely filling a retainer cup 82, the player may perform a balance cycle. Players may perform a balance cycle on each turn in which there is at least one full retainer cup 82 in the game base 71. Players must still place at least one or two stacks on each turn. If a player has stacks that only match filled retainer cups 82, the player must perform a balance cycle without placement.

A player must empty all of the retainer cups 82 and keep all of the coin stacks if the balance cycle is successful. The winning player then replaces the empty retainer cups 82, raises the mast one notch, and resumes play by starting the next round. The game ends when one player has all of the coin stacks.

iv. Fourth Game

Second Embodiment

The fourth game utilizes the second embodiment of the apparatus 70. The fourth game is set in an outer space scenario. The fourth game is a two player skill and strategy game in which the object of the game is to move coins 80 from the load side to the pay side by balancing the load. The player with the most pay at the end of the game collects pay and wins the game.

Two players begin with five quarters, ten dimes, twenty nickels, and twenty-five pennies on the load side of a game board, base 71, or other place. The game begins with the apparatus 70 placed in the holder 79 and the wings 106 at a first level. Next, the players flip a coin to see who goes first.

On each turn, a player must place a number of coins 109 in one wing 106 container 108 equal or greater than the numbered level at which the wings 106 are located. For example, on level one a player must place at least one coin 109 in a wing cup 108. On level five, at least five coins 109 must be placed in the wing cup 108 on each turn in which coins are placed. A player may only place coins in a single cup per turn. After placing coins 109, the player may perform a balance cycle. If the balance cycle is successful, the player may keep the entire payload as pay, and start the next round at the next lower wing level.

If both players' balance cycles are unsuccessful, then the wings 106 are moved down one level. Two consecutive unsuccessful balance cycles at one level results in lowering the wings 106 one level. The players now have a choice of placing at least the minimum number of coins 109 corresponding to the wing level or attempting a balance cycle.

The first player to run out of load coins may take all of the opponents load coins and use them as his own. The rules of coin placement must be followed and players continue to take turns with balancing cycles until all coins are removed from both loading areas and the wing 106 cups. If a player chooses, he may take coins from his pay and load them on his turn.

v. Fifth Game

Third Embodiment

The fifth game utilizes a third embodiment of the apparatus 70 and preferably is a tournament type game. The fifth game generally includes one die, one tandem launcher 110', four apparatuses 70, four holders 79, and sixteen assorted rigging pieces. Each player chooses an apparatus 70 and places it in a holder 79. The rigging will be chosen according to the rules of play. The sail 100 may be formed in various sizes, shapes and configurations.

During game play, the players initially roll the dies to determine who goes first and then turns go clockwise. Each player takes turns choosing one piece of rigging until all are chosen. When each player has finished choosing rigging the tournament begins.

The tournament follows a plurality of matches. Each match is won by the best three out of five wobbles with the apparatus 70. One wobble includes placing at least four pieces of rigging on the base 71 in any orientation and simultaneously releasing the base 71 with the launcher 110. Once launching has started, the base 71 cannot be touched until rested.

The goal of each wobble is determined by rolling the die. If the die shows a one, two, or three then the goal of the wobble is to be the first to balance. If the die shows a four, five, or six then the goal of the wobble is to be the last to balance. The base's 71 rigging may be adjusted before each wobble and designed to balance slowly or quickly depending on the goal of the wobble. If neither of the bases 71 balance, then the wobble is repeated.

During two player matches, any number of matches including the best three of five wobbles wins. The players may reorganize the rigging after each wobble, and the winner of the match may choose to trade one piece of rigging with the loser.

Each player picks a number as part of the process of choosing the rigging. If all the players win one match in a three player tournament, then the tournament is replayed. The winner will have won two matches, second place will have won one and lost one, and third place will have lost two matches.

The winner of each match may choose to trade one piece of rigging with the losing player.

Two matches may be played simultaneously. A score sheet should be employed to keep track of the winners of each match. The player who wins the most matches wins the tournament. In the event of three players from the four player tournament have each won two matches, the three players must then enter a three player tournament as described previously. When moving from a four player into a three player tournament, all of the numbered flags are set in the center and players roll the die to determine the order in which to pick a new number. Again, the winner of each match may choose to trade one piece of rigging with the losing player.

To launch two apparatuses 70 at the same time, place the top of each vertical extension 91 in contact with the launcher 110'. After any final adjustments are made, one player will push the launch trigger 115' down and quickly remove the launcher 110' from the play area so the apparatuses 70 do not come into contact with the launcher 110'.

vi. Sixth Game

Fourth Embodiment

The sixth game utilizes a fourth embodiment of the apparatus 70 and is utilized to time a player's turn. The time elapsed from initiation to cessation of wobbling is very repeatable at a given setting. The setting may be altered to allow variation in the time of a player's turn. This allows for a multitude of options when designing games which involve a time span allotted to players.

Players can adjust the timer by sliding the circular clamp 93 higher or lower. This changes the moment of inertia, resulting in longer or shorter wobbling times. For example, removing the circle clamp 93 and tipping the apparatus 70 approximately 70 degrees from vertical and releasing gives a wobbling time of approximately 30 seconds. With the clamp 93 positioned at a lower marked setting, the apparatus 70 give approximately 45 seconds of play time. With the clamp 93 at a top marked setting, the apparatus 70 gives approximately 60 seconds of play time.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An apparatus for determining an outcome of a game, comprising:

a base including a curved portion and a flat portion;

wherein said flat portion is positioned at a lowermost end of said base and wherein said curved portion extends from said flat portion;

at least one ballast for adding weight to said base;

wherein said at least one ballast is positioned proximate said base; and an adjustable counterbalance mechanism for stabilizing said base on said flat portion, wherein said counterbalance mechanism extends from said base;

wherein said counterbalance mechanism includes a plurality of sails.

2. The apparatus of claim 1, wherein said curved portion is comprised of a hemispherical shape.

3. The apparatus of claim 1, wherein said ballast is adjustable with respect to said base.

4. The apparatus of claim 1, wherein said ballast is comprised of a plurality of coins.

5. The apparatus of claim 1, wherein said counterbalance mechanism includes an adjustable vertical extension for adjusting a height of at least a portion of said counterbalance mechanism.

6. The apparatus of claim 5, wherein said vertical extension telescopingly adjusts.

7. The apparatus of claim 1, wherein said base includes a plurality of holes for selectively receiving said at least one ballast.

8. The apparatus of claim 1, wherein said counterbalance mechanism includes a plurality of adjustable wings.

9. The apparatus of claim 8, wherein said plurality of wings include a plurality of retainer cups.

10. The apparatus of claim 9, wherein said plurality of retainer cups hold a plurality of weighted objects.

11. The apparatus of claim 1, wherein said counterbalance mechanism includes a magnetized weighted object.

12. The apparatus of claim 11, wherein said magnetized weighted object is removably securable to said base.

13. An apparatus for determining an outcome of a game, comprising:

a base including a curved portion and a flat portion;

wherein said flat portion is positioned at a lowermost end of said base and wherein said curved portion extends from said flat portion;

at least one ballast for adding weight to said base;

wherein said at least one ballast is positioned proximate said base; and an adjustable counterbalance mechanism for stabilizing said base on said flat portion, wherein said counterbalance mechanism extends from said base and wherein said counterbalance mechanism includes a plurality of adjustable wings.

14. The apparatus of claim 13, wherein said curved portion is comprised of a hemispherical shape.

15. The apparatus of claim 13, wherein said ballast is adjustable with respect to said base.

16. The apparatus of claim 13, wherein said ballast is comprised of a plurality of coins.

17. The apparatus of claim 13, wherein said counterbalance mechanism includes an adjustable vertical extension for adjusting a height of at least a portion of said counterbalance mechanism.

18. An apparatus for determining an outcome of a game, comprising:

a base including a curved portion and a flat portion;

wherein said flat portion is positioned at a lowermost end of said base and wherein said curved portion extends from said flat portion;

at least one ballast for adding weight to said base;

wherein said at least one ballast is positioned proximate said base; and an adjustable counterbalance mechanism for stabilizing said base on said flat portion, wherein said counterbalance mechanism extends from said base and wherein said counterbalance mechanism includes a magnetized weighted object.

19. The apparatus of claim 18, wherein said magnetized weighted object is removably securable to said base.

* * * * *